US011680760B2

(12) United States Patent
Taunton

(10) Patent No.: US 11,680,760 B2
(45) Date of Patent: Jun. 20, 2023

(54) ROTATING GUN BOLT ASSEMBLY

(71) Applicant: Scott W. Taunton, Rockingham, NC (US)

(72) Inventor: Scott W. Taunton, Rockingham, NC (US)

( * ) Notice: Subject to any disclaimer, the term of this patent is extended or adjusted under 35 U.S.C. 154(b) by 0 days.

(21) Appl. No.: 17/682,429

(22) Filed: Feb. 28, 2022

(65) Prior Publication Data

US 2022/0341686 A1 Oct. 27, 2022

Related U.S. Application Data

(60) Provisional application No. 63/178,516, filed on Apr. 22, 2021.

(51) Int. Cl.
*F41A 3/46* (2006.01)

(52) U.S. Cl.
CPC ..... *F41A 3/46* (2013.01)

(58) Field of Classification Search
CPC ..... F41F 1/10; F41A 3/26; F41A 3/46; F41A 19/30
USPC ..... 42/14, 16; 89/1.41
See application file for complete search history.

(56) References Cited

U.S. PATENT DOCUMENTS

| | | | | |
|---|---|---|---|---|
| 125,563 | A | 4/1872 | Gatling | |
| 1,743,472 | A * | 1/1930 | Meyer | F41A 3/26 89/14.3 |
| 2,849,921 | A | 4/1954 | Otto | |
| 3,380,343 | A | 4/1968 | Chiabrandy et al. | |
| 3,595,128 | A | 7/1971 | Hoyt | |
| 3,611,866 | A | 10/1971 | Jacolucci et al. | |
| 3,766,821 | A | 10/1973 | Cozzy et al. | |
| 6,742,434 | B1 | 6/2004 | Dillon | |
| 9,587,895 | B1 | 3/2017 | Abbott | |
| 2017/0074609 | A1 * | 3/2017 | Michlin | F41A 3/26 |
| 2020/0263955 | A1 | 8/2020 | Dewalch | |

FOREIGN PATENT DOCUMENTS

| | | | | |
|---|---|---|---|---|
| GB | 237723 | A * | 7/1924 | F41A 19/30 |

* cited by examiner

*Primary Examiner* — Bret Hayes
(74) *Attorney, Agent, or Firm* — Jeffrey C. Watson; Grell & Watson Patent Attorneys LLC

(57) ABSTRACT

A rotating gun bolt assembly includes a main body subassembly and a head subassembly. The main body subassembly including a helical receiving pocket. The head subassembly includes a head end and a rear end. The rear end of the head subassembly includes a helical tang extending from the rear end and mated with the helical receiving pocket in the main body subassembly. The helical tang includes a straight side, a distal edge and a helical side. The straight side extends perpendicular from the rear end of the head subassembly. The distal edge extends perpendicular to the straight side, where the distal edge is parallel with the rear end of the head subassembly. The helical side extends helically from the rear end of the head subassembly to the distal edge of the helical tang.

19 Claims, 19 Drawing Sheets

ROTATING GUN BOLT ASSEMBLY

CROSS-REFERENCE TO RELATED APPLICATIONS

This application claims benefit to U.S. Provisional Patent Application No. 63/178,516 filed on Apr. 22, 2021, entitled ROTATING GUN BOLT ASSEMBLY, which is incorporated by reference in its entirety.

FIELD OF THE DISCLOSURE

The present disclosure relates to an improvement for a rotating gun bolt assembly. More specifically, the present disclosure is directed to a self-locking, and resetting bolt assembly, especially adapted for automatic weapons having a plurality of barrels mounted for rotation about a common axis, like for use in a Gatling gun, miniguns, m134, GAU-2, or the like.

BACKGROUND

Generally speaking, an automatic weapon or firearm is an auto-loading weapon that continuously chambers, and fires rounds when the trigger mechanism is actuated. The action of a typical automatic weapon is capable of harvesting the excess energy released from a previous discharge to feed a new ammunition round into the chamber, and then ignite the propellant and discharge the projectile (either bullet, shots or slug) by delivering a hammer/striker impact on the primer. Unlike typically automatic weapons, the instant disclosure may be described for use in automatic weapons having a plurality of barrels mounted for rotation about a common axis that use an external force, like a crank or an electric motor, for rotating the barrels and feeding the new ammunition into the rotating barrels, like for use in a Gatling gun, miniguns, m134, GAU-2, or the like.

In U.S. Pat. No. 125,563, issued Apr. 9, 1872 to R. J. Gatling and incorporated fully herein by reference, there is shown the classic modern revolving battery gun. A stationary housing encloses and supports a rotor assembly which has a plurality of barrels and a like plurality of bolts. Each bolt has its own firing pin and mainspring. Each bolt is traversed longitudinally by a stationary elliptical cam track in the housing. As the bolt is traversed forward, the firing pin is held to the rear by a stationary cam track in the housing and the mainspring is compressed until the bolt and the barrel reach the firing position, at which time the firing pin is scared. More recent electrically fired gun is shown in U.S. Pat. No. 2,849,921, issued Sep. 2, 1958 to H. McC.Otto and incorporated fully herein by reference. In this patent, the longitudinal movement of the bolt is controlled by a housing cam track, but the firing pin is always biased forward. A yet more recent Gatling gun, disclosed in U.S. Pat. No. 3,380,343, issued Apr. 30, 1968 to R. E. Chiabrandy et al. and incorporated fully herein by reference, utilizes a single mainspring mounted externally of the bolt assemblies on the housing. The most commonly used M-134 bolt design in recent times is described in U.S. Pat. No. 3,611,866, issued in 1971 and assigned to the General Electric Company (referred to herein as the "GE Bolt") and incorporated fully herein by reference. A recent improvement is described in U.S. Pat. No. 6,742,434 to Dillon, (referred to herein as the "Dillon Bolt," FIGS. 4 and 5). The standard operation of an M-134 with the GE Bolt is described at length in the GE Bolt patent. The operation is virtually identical with the Dillon Bolt.

To summarize, and using the Dillon Bolt as an illustration, the release mechanism is built into the firearm bolt 1 itself. The bolt follows a track on the inside casing of the receiver, traveling a helical path such that the forward most position is the firing position. The bolt acquires an ammunition cartridge in its travel and, as it moves forward, chambers the cartridge. At this point, the bolt head is against a barrel face and the helical track continues moving the assembly forward. The continuing track forces the bolt carrier and head to compress against each other. A helical cam arm 5, cantilevered and extending from the bolt head 7, interfaces with a helical cam slot 4 in the bolt carrier 2, causing the head 7 to twist in relation to the bolt carrier 2, while simultaneously the compression cocks the firing pin 3. When fully twisted, the firing pin 3 releases and strikes the cartridge primer. The firing pin is a compression spring with a blocking pin located aft of the spring. It is also linked to the head of the bolt by a separate release pin interfacing with an L-shaped slot with transverse and longitudinal legs. In its default position, the release pin resides in the transverse leg of the slot. Thus, as the bolt head and carrier collapse against each other, the firing pin is biased against the spring as it is forced against the spring by its interaction with the transverse slot. When the bolt head and carrier reach their point of maximum rotational difference, the release pin is forced to fall off the corner of the L-shaped slot. This translation frees the release pin, and thus the firing pin, for motion along the longitudinal leg. This releases the firing pin to strike the cartridge primer with enough force to cause an ignition of the propellant contained within the cartridge. As the firearm bolt cycles away from the forward-most position, the bolt head and carrier re-align, causing the engagement pin to relocate in the transverse leg of the L-slot, resetting for the next firing cycle.

This is accomplished by the housing which encloses and supports a rotor assembly which has a plurality of barrels and a matched plurality of bolts. Each bolt has its own firing pin and mainspring. Each bolt is traversed longitudinally by a stationary elliptical cam track in the housing. As the bolt is traversed forward by the stationary cam track in the housing the firing pin is held to the rear by an L shaped slot on the front body and the mainspring is compressed while rotating along a helical path on the tang (front body) and slot (rear body) until the bolt and the barrel reach.

The instant disclosure recognizes that at least one disadvantage of the GE Bolt involved the helical cam arm of the bolt head. As rotation was caused solely by the interaction of this single helical cam arm and a corresponding cam slot on the body, asymmetrical loads were placed on a singular and thin area of the bolt head. This caused a higher than desired rate of failure as these cam arms would occasionally break, rendering the bolt inoperative. This issue was addressed with the Dillon Bolt by adding a second helical cam arm 8 and cam slot 9 to the bolt structure to reduce the loads on a single cam arm 5; and, furthermore, the bolt could still function should one cam arm fail. However, while the Dillon Bolt is a marked improvement over the prior GE Bolt, it still relies on two thin cantilevered appendages which, over time and with repeated loads, will eventually fail. What is needed is a firearm bolt which reduces or eliminates the loads placed on weaker areas of the structure while also being compatible with current M-134 designs.

The instant disclosure may be designed to address at least certain aspects of the problems or needs discussed above by providing a rotating gun bolt assembly.

SUMMARY

The present disclosure may solve the aforementioned limitations of the currently available gun bolt assemblies, by providing a rotating gun bolt assembly. The rotating gun bolt assembly may generally include a main body subassembly and a head subassembly. The main body subassembly may include a helical receiving pocket. The head subassembly may include a head end and a rear end. The rear end of the head subassembly may include a helical tang extending from the rear end and mated with the helical receiving pocket in the main body subassembly. The helical tang may include a straight side, a distal edge, and a helical side. The straight side of the helical tang may extend perpendicular from the rear end of the head subassembly. The distal edge of the helical tang may extend perpendicular to the straight side, where the distal edge of the helical tang is parallel with the rear end of the head subassembly. The helical side of the helical tang may extend helically from the rear end of the head subassembly to the distal edge of the helical tang.

One feature of the disclosed rotating gun bolt assembly may be that when the head subassembly and the main body subassembly are compressed, the helical receiving pocket may exert tangential forces on the distal edge of the helical tang. These tangential forces may be configured to rotate the head subassembly about a longitudinal axis of the rotating gun bolt assembly.

In select embodiments of the disclosed rotating gun bolt assembly the main body subassembly may include lateral main body slots on opposite main body sides of the main body subassembly. The lateral main body slots may be configured to move the main body subassembly longitudinally along guides of a rotor assembly. The head subassembly may similarly include lateral head slots on opposite head sides of the head subassembly. The lateral head slots may be configured to move the head subassembly longitudinally along the guides. In these select embodiments, twisting of the head subassembly about the longitudinal axis may be accomplished by translating compression forces between the head subassembly and the main body subassembly into a rotational force imparted into the main body subassembly and head subassembly along the longitudinal axis parallel to the guides. Whereby a twisting motion may be imparted to the head subassembly as it translates longitudinally along the main body subassembly while imparting the rotational forces back into the guides throughout longitudinal travel along the longitudinal axis.

Another feature of the disclosed rotating gun bolt assembly may be that the helical tang on the head subassembly and lateral main body slots on the main body subassembly may be configured as such that compression loads and rotational loads implied are imparted to the respective main head subassembly and main body subassembly as tangential loads and divided across the head subassembly and main body subassembly through helical mating surfaces created by the helical receiving pocket and the helical tang, while supported by a mass of material with a base having a width, and a length of the helical tang.

In select embodiments, the disclosed rotating gun bolt assembly may further include a firing pin subassembly. The firing pin subassembly may be positioned within an axial bore along the longitudinal axis of the rotating gun bolt assembly through the main body subassembly and the head subassembly. One feature of the disclosed rotating gun bolt assembly may be that the firing pin subassembly may be configured to support axial and radial constraint between the main body subassembly and the head subassembly.

In select embodiments of the disclosed rotating gun bolt assembly, the firing pin subassembly may include a firing pin with an aft driving cross pin and a forward driving pin. The firing pin may have a forward primer striking end initially contained in the head subassembly. The firing pin may be biased from the main body subassembly toward the head subassembly via a firing pin spring. The firing pin may include a rear axial slot and a forward hole. The aft driving cross pin may be positioned through the rear axial slot of the firing pin. The firing pin spring may bias the firing pin via the aft driving cross pin. The forward driving pin may be positioned through the forward hole of the firing pin. One feature of the disclosed rotating gun bolt assembly may be that the firing pin may be configured to freely move within the axial bore within the limitations of the aft driving cross pin and the forward driving pin.

Another feature of the disclosed rotating gun bolt assembly may be the inclusion of a top driving wedge and a bottom driving wedge on the main body subassembly. The top driving wedge and the bottom driving wedge may be configured to control movement of the aft driving cross pin therein. Each of the top driving wedge and the bottom driving wedge may include a triangular shape with a longitudinal surface, a transverse surface, and a hypotenuse surface.

Another feature of the disclosed rotating gun bolt assembly may be the inclusion of an L-shaped slot in the head subassembly. The L-shaped slot may be configured to control the movement of the forward driving pin therein. The L-shaped slot may include an L-shape with a longitudinal leg, and a transverse leg.

In select embodiments of the rotating gun bolt assembly, the main body subassembly may further include a cam bearing positioned thereon. The cam bearing may be configured to drive the axial movement of the rotating gun bolt assembly by means of an elliptical cam path in a main housing of a firearm.

Another feature of the disclosed rotating gun bolt assembly may be that while in a feed position, the main body subassembly and the head subassembly may be at a maximum axial separation where the firing pin aligns and supports axial and radial constraint of the main body subassembly and the head subassembly with the aft driving cross pin against a longitudinal forward apex between the longitudinal surface and the hypotenuse surface of the top driving wedge and the bottom driving wedge. In this feed position, the forward driving pin may be located in a distal end of the transverse leg of said L-shaped slot. The firing pin spring may be in a static compression attributed to the aft driving cross pin and the rear axial slot of the firing pin.

Another feature of the disclosed rotating gun bolt assembly may be that when the firing pin spring is compressed by the main body subassembly via the cam bearing following the elliptical cam path until the rotational force created by the helical tang and the helical receiving pocket, the tangential force causes the forward driving pin to move into a scared position, where the main body subassembly and the head subassembly are at a minimum axial separation with the head subassembly having been rotated around the firing pin.

Another feature of the disclosed rotating gun bolt assembly may be that when the firing pin spring is continued to be compressed by the main body subassembly via the cam bearing following the elliptical path with the aft driving cross pin located against longitudinal surfaces of the top driving wedge and the bottom driving wedge, the tangential force causes the forward driving pin in the longitudinal leg of the L-shaped slot, where the firing pin is biased further into the head subassembly and the forward primer striking end of the firing pin extending forward of the forward bolt face thereby igniting a primer.

Another feature of the disclosed rotating gun bolt assembly may be that during an extraction function, the forward driving pin may be forced to the traverse leg of the L-shaped slot to positively withdraw the forward primer striking end into the head subassembly.

Another feature of the disclosed rotating gun bolt assembly may be that during a reset function, the aft driving cross pin may be forced relatively forward along the hypotenuse surface of the top driving wedge and the bottom driving wedge to swing the forward driving pin into the distal end of the transverse leg of the L-shaped slot.

In select embodiments of the disclosed rotating gun bolt assembly, the head subassembly may further include a head body having a forward bolt face and extractor lugs.

In another aspect, the instant disclosure embraces the rotating gun bolt assembly in any embodiment and/or combination of embodiments shown and/or described herein.

In another aspect, the instant disclosure embraces a firearm with the rotating gun bolt assembly in any embodiment and/or combination of embodiments shown and/or described herein.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
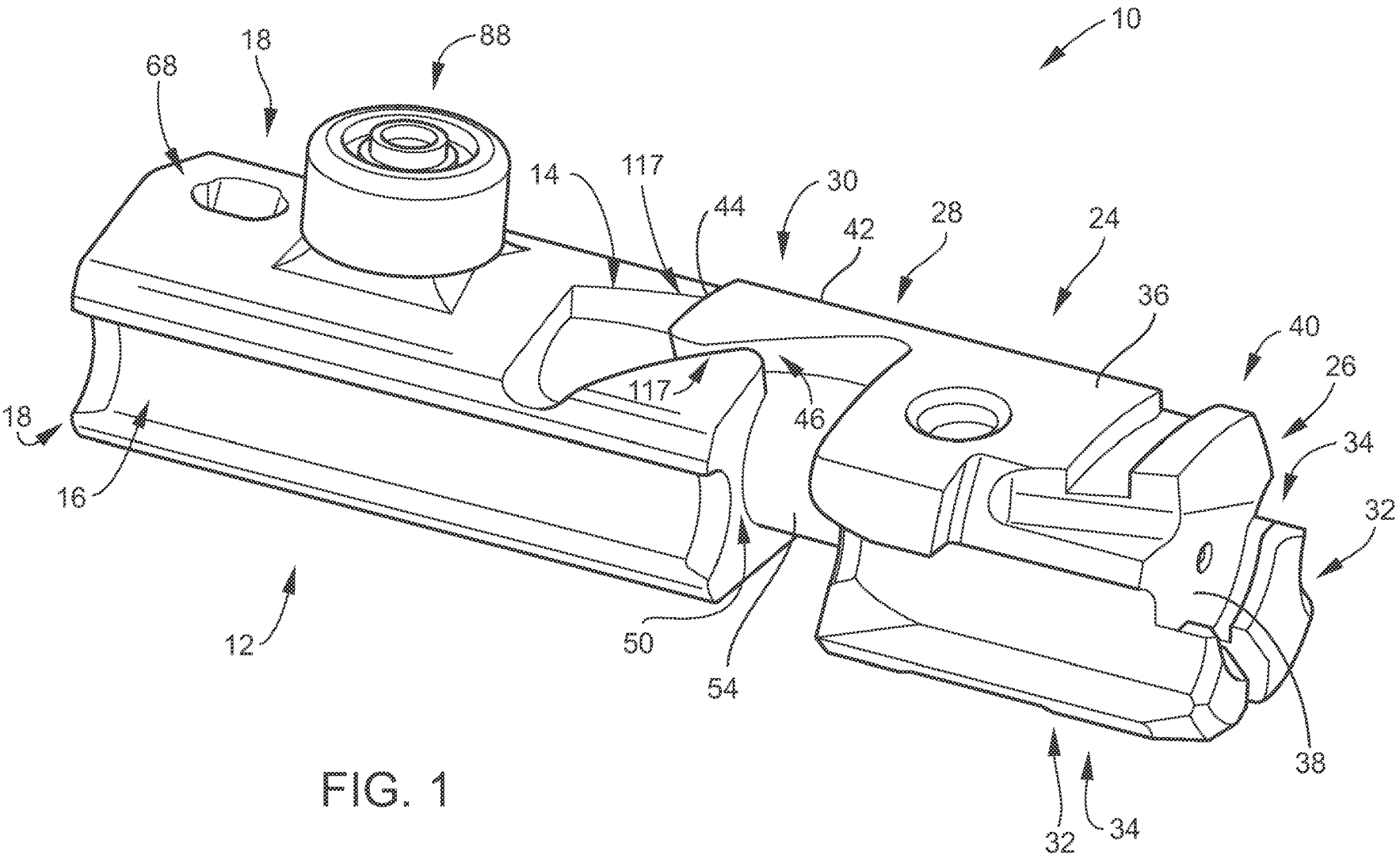
FIG. 1 is a top, front, left side perspective view of the rotating gun bolt assembly according to select embodiments of the instant disclosure.
Figure 2:
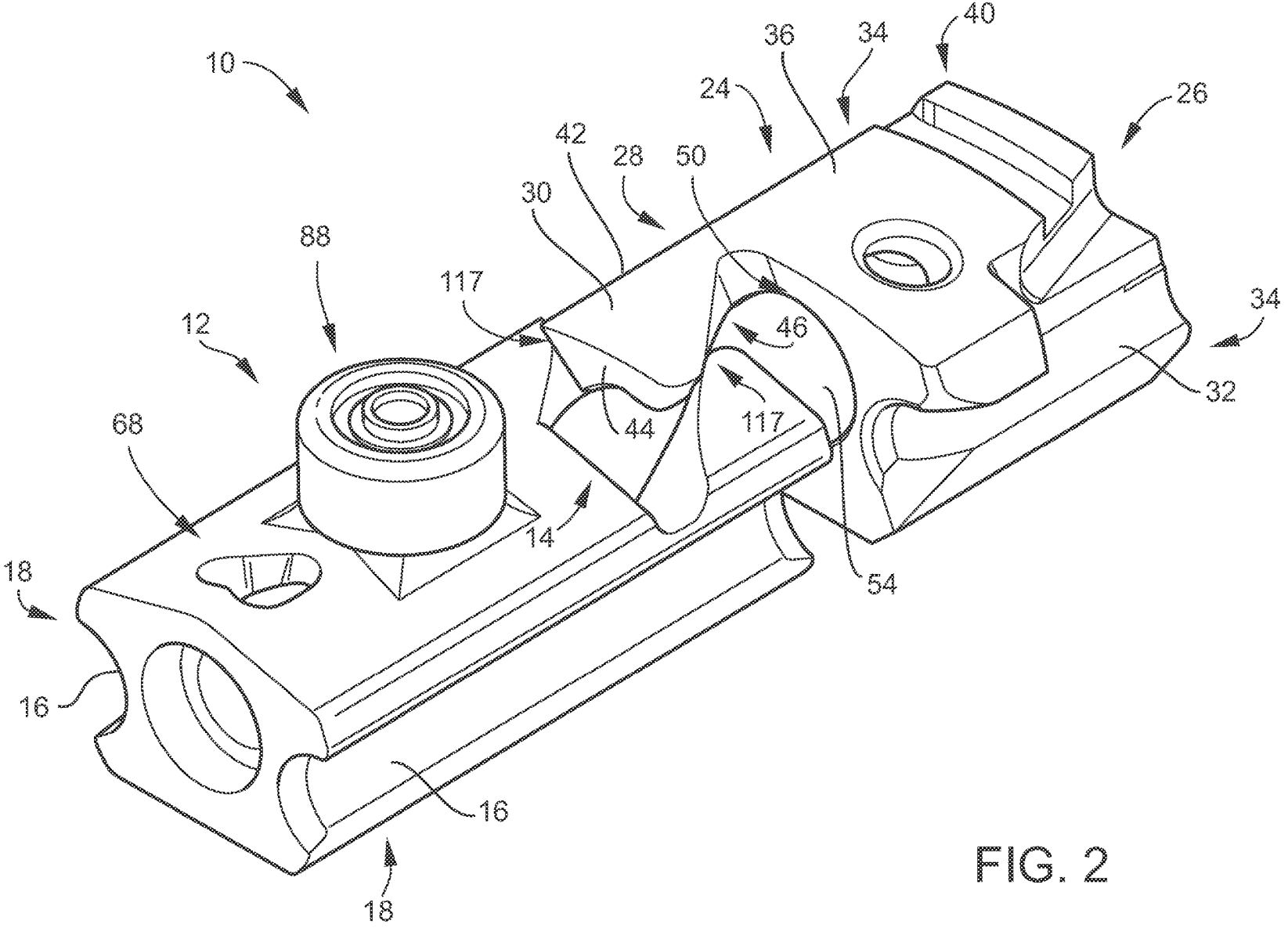
FIG. 2 is a top, rear, left side perspective view of the rotating gun bolt assembly of FIG. 1.
Figure 3:
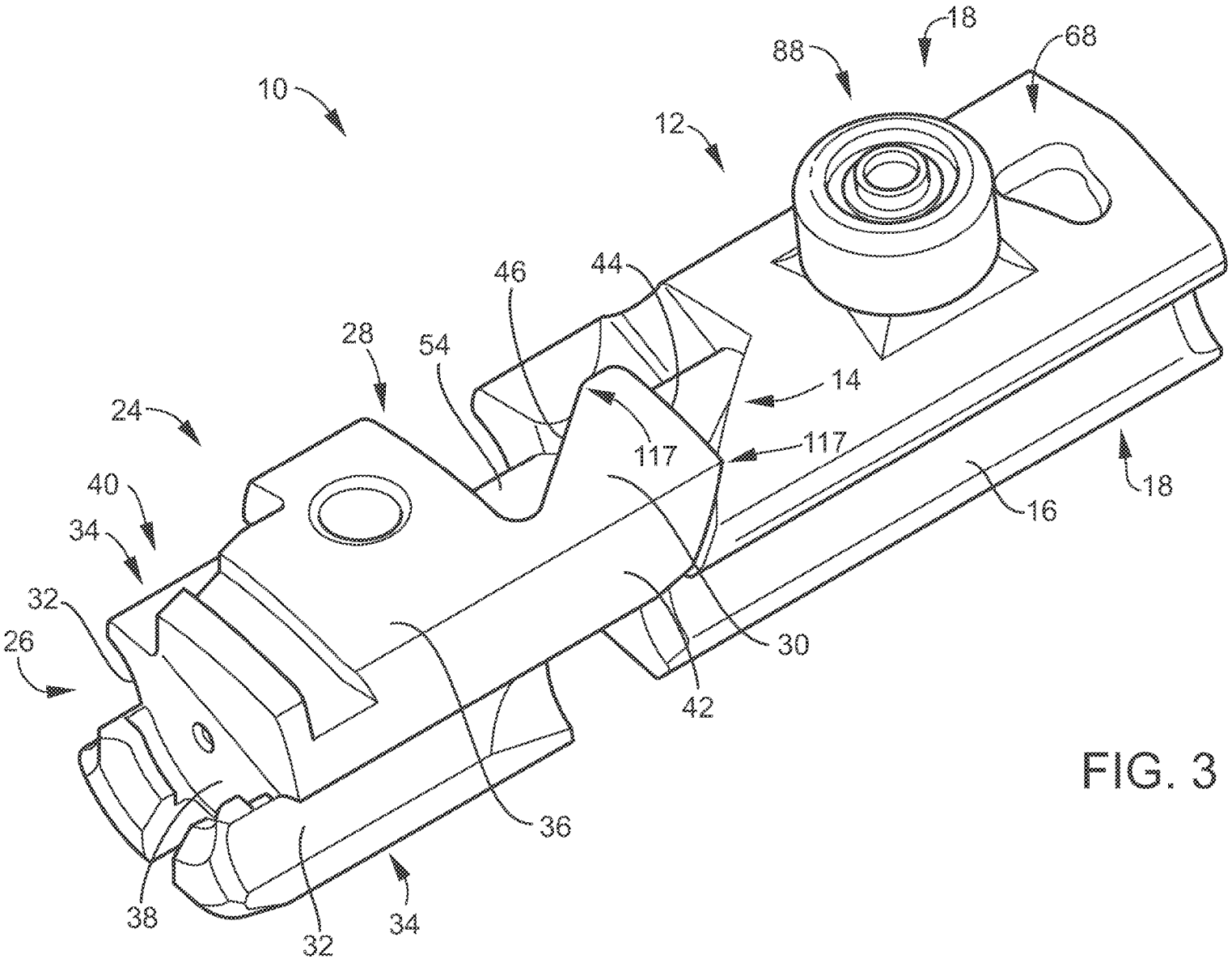
FIG. 3 is a top, front, right side perspective view of the rotating gun bolt assembly of FIG. 1.
Figure 4:
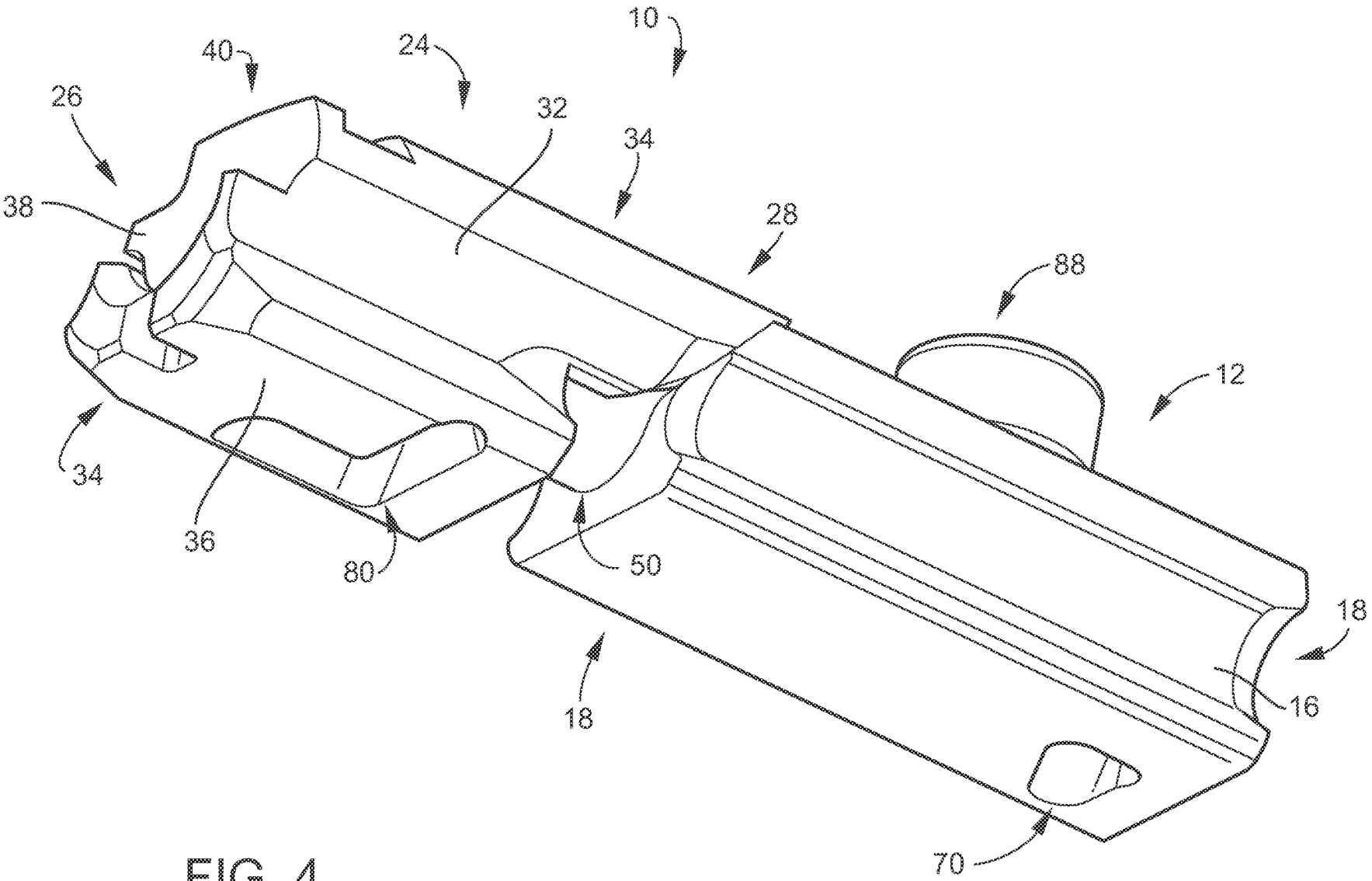
FIG. 4 is a bottom, front, right side perspective view of the rotating gun bolt assembly of FIG. 1.
Figure 5:
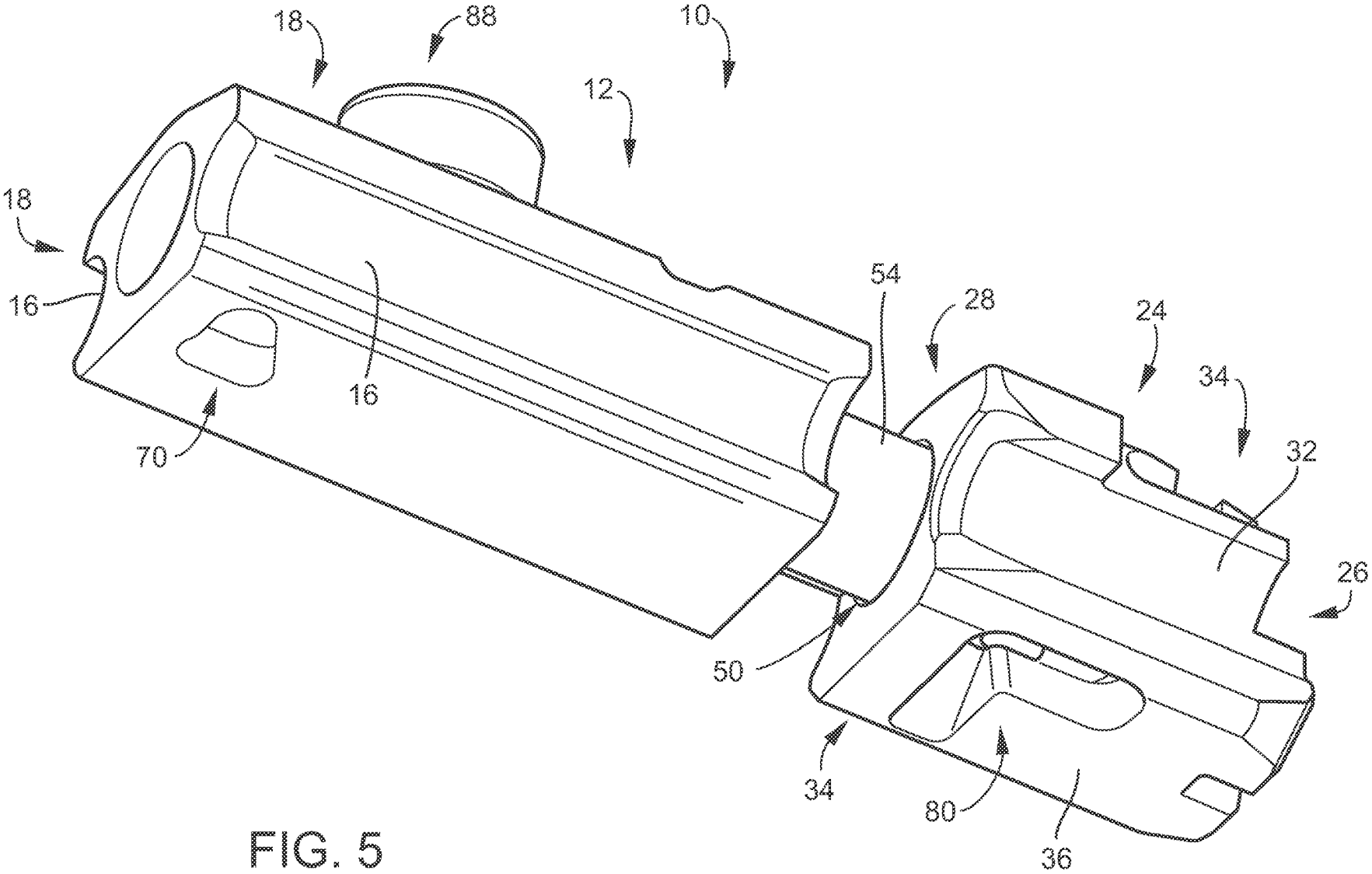
FIG. 5 is a bottom, rear, left side perspective view of the rotating gun bolt assembly of FIG. 1.
Figure 6:
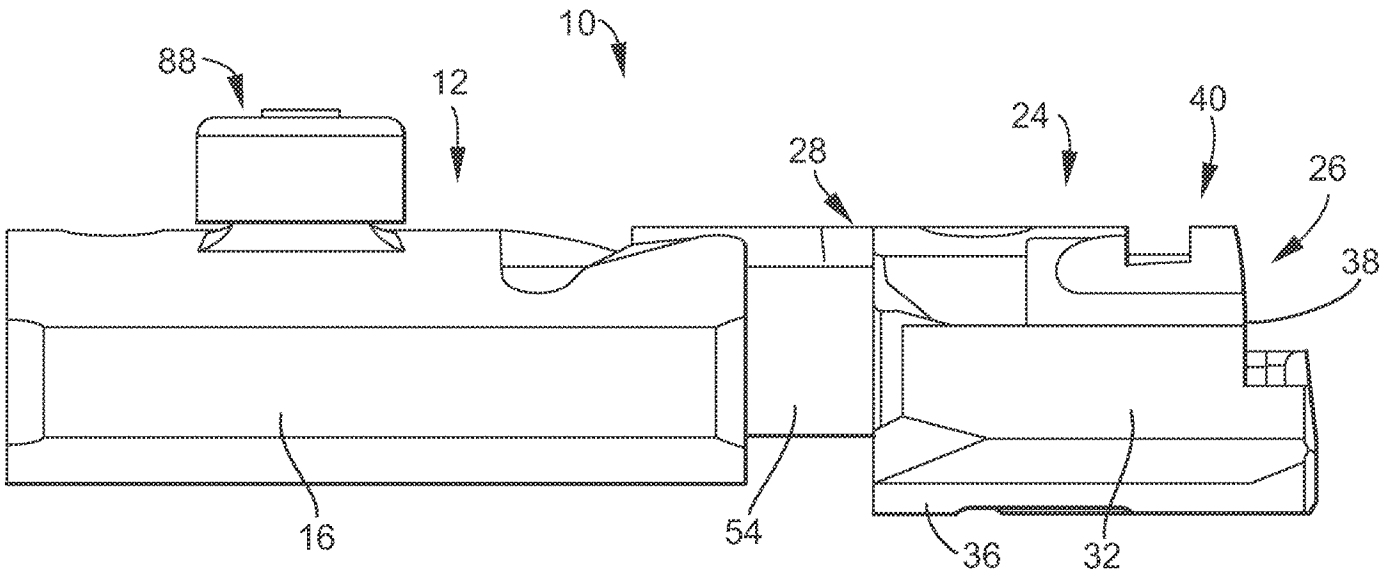
FIG. 6 is left-side view of the rotating gun bolt assembly of FIG. 1.
Figure 7:
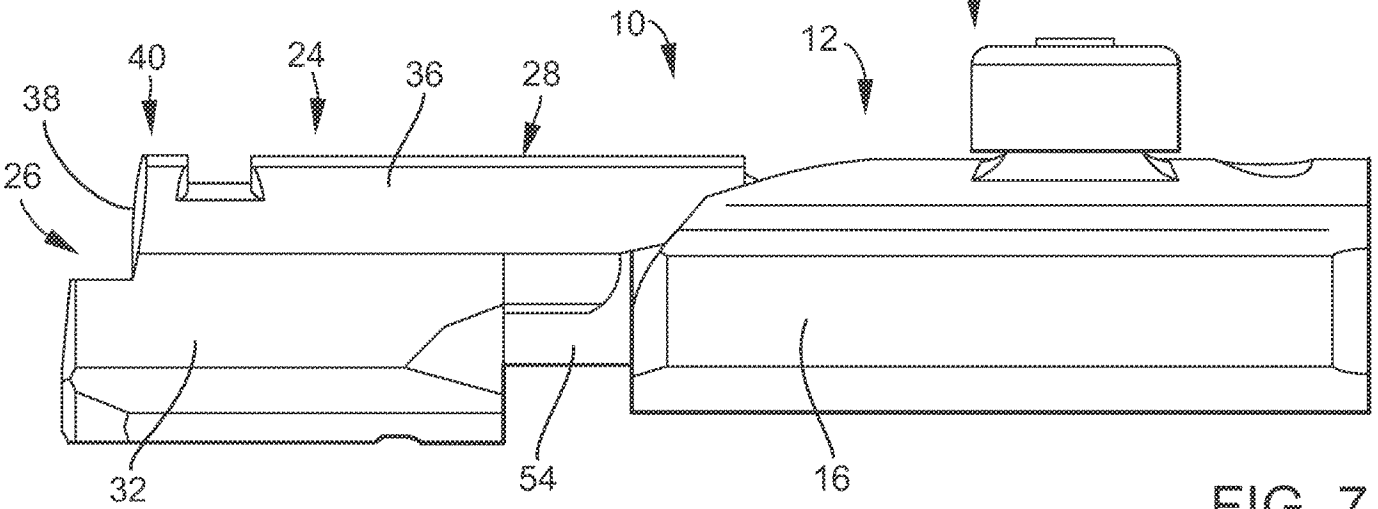
FIG. 7 is a right-side view of the rotating gun bolt assembly of FIG. 1.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-23, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring to FIGS. 1-18, the present disclosure may solve the aforementioned limitations of the currently available gun bolt assemblies by providing the disclosed rotating gun bolt assembly 10. Rotating gun bolt assembly 10 may generally include a main body subassembly 12 and head subassembly 24. These parts and their functions will be described in greater detail below.

Main body subassembly 12 may be included as a piece or part of rotating gun bolt assembly 10. Main body subassembly 12 may be for providing the main portion or part of rotating gun bolt assembly 10. Main body subassembly 12 may include helical receiving pocket 14.

Head subassembly 24 may be included as a piece or part of rotating gun bolt assembly 10. Head subassembly 24 may be for providing head portion or part of rotating gun bolt assembly 10. Head subassembly 24 may include head end 26 and rear end 28. Rear end 28 of head subassembly 24 may include helical tang 30 extending from rear end 28 and mated with helical receiving pocket 14 in main body subassembly 12. In select embodiments, helical tang 30 may include straight side 42, distal edge 44, and helical side 46. Straight side 42 of helical tang 30 may extend perpendicular from rear end 28 of head subassembly 24. Distal edge 44 of helical tang 30 may extend perpendicular to straight side 42 of helical tang 30, where distal edge 44 of helical tang 30 may be parallel with rear end 28 of head subassembly 24. Helical side 46 of helical tang 30 may extend helically from rear end 28 of head subassembly 24 to distal edge 44 of helical tang 30. In select embodiments of rotating gun bolt assembly 10, as shown in the Figures, head subassembly 24 may further include head body 36 having forward bolt face 38 with a hole therein for receiving forward primer striking end 56 of firing pin 54, and extractor lugs 40 configured for extracting the casing after firing.

One feature of rotating gun bolt assembly 10 may be that when head subassembly 24 and main body subassembly 12 are compressed (see FIGS. 18A-18D), helical receiving pocket 14 may exert tangential forces 111 on distal edge 44 of helical tang 30. These tangential forces 111 may be configured to rotate head subassembly 24 about longitudinal axis 52 (see FIG. 13) of rotating gun bolt assembly 10.

As shown in FIGS. 1-18, in select embodiments of rotating gun bolt assembly 10, main body subassembly 12 may include lateral main body slots 16 on opposite main body sides 18 of main body subassembly 12. These lateral main body slots 16 may be configured to move main body subassembly 12 longitudinally along guides 20 of rotor assembly 22, like as shown in FIGS. 19-23 of firearm 94. Head subassembly 24 may similarly include lateral head slots 32 on opposite head sides 34 of head subassembly 24. These lateral head slots 32 may be configured to move head subassembly 24 longitudinally along guides 20 of rotor assembly 22, like as shown in FIGS. 19-23 for firearm 94. In these select embodiments, twisting of head subassembly 24 about longitudinal axis 52 may be accomplished by translating compression forces 114 between head subassembly 24 and main body subassembly 12 into rotational force 115 imparted into main body subassembly 12 and head subassembly 24 along longitudinal axis 52 parallel to guides 20. Whereby a twisting motion may be imparted toe head subassembly 24 as it translates longitudinally along main body subassembly 12 while imparting the rotational forces 115 back into guides 20 throughout longitudinal travel along longitudinal axis 52.

Figure 8:
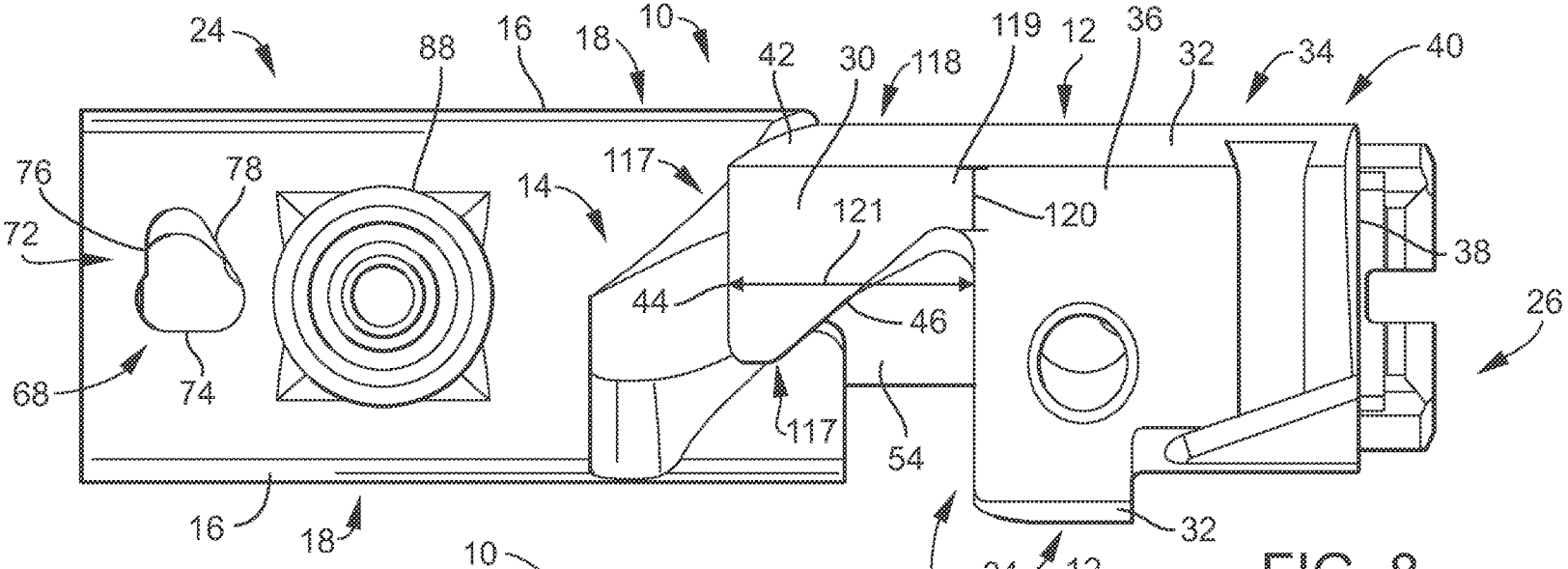
FIG. 8 is a top view of the rotating gun bolt assembly of FIG. 1.

Another feature of rotating gun bolt assembly 10 may be that helical tang 30 on head subassembly 24 and lateral main body slots 16 on main body subassembly 12 may be configured as such that compression loads 114 and rotational loads 115 implied are imparted to the respective main head subassembly 24 and main body subassembly 12 as tangential loads 111 and divided across head subassembly 24 and main body subassembly 12 through helical mating surfaces 117 created by helical receiving pocket 14 and helical tang 30. As best shown in FIG. 8, helical tang 30 may be supported by mass of material 118 at base 119 with width 120, and length 121 of helical tang 30. In select embodiments, helical tang 30 may have mass of material 118 at base 119 with width 120 that is greater than Dillon Bolt and/or the GE Bolt. In select embodiments, as an example, and clearly not limited thereto, helical tang 30 may have mass of material 118 at base 119 with width 120 that is 10% or greater in size than Dillon Bolt and/or the GE Bolt. In select embodiments, as an example, and clearly not limited thereto, helical tang 30 may have mass of material 118 at base 119 with width 120 that is 20% or greater in size than Dillon Bolt and/or the GE Bolt.

As best shown in FIGS. 12-18, in select embodiments, rotating gun bolt assembly 10 may further include firing pin subassembly 48. Firing pin subassembly 48 may be positioned within axial bore 50 along longitudinal axis 52 of rotating gun bolt assembly 10, through both main body subassembly 12 and head subassembly 24. One feature of rotating gun bolt assembly 10 may be that firing pin subassembly 48 may be configured to support axial and radial constraint between main body subassembly 12 and head subassembly 24.

As best shown in FIGS. 12-17, in select embodiments of rotating gun bolt assembly 10, firing pin subassembly 48 may include firing pin 54 with aft driving cross pin 64 and forward driving pin 66. Firing pin 54 may have forward primer striking end 56 initially contained in head subassembly 24, as shown in these Figures. Firing pin 54 may be biased from main body subassembly 12 toward and further into head subassembly 24 via firing pin spring 58 (see FIGS. 15-17). Firing pin 54 may include rear axial slot 60 and forward hole 62. Aft driving cross pin 64 may be positioned through rear axial slot 60 of firing pin 54. Firing pin spring 58 may bias firing pin 54 via aft driving cross pin 64. Forward driving pin 66 may be positioned through forward hole 62 of firing pin 54. One feature of rotating gun bolt assembly 10 may be that firing pin 54 may be configured to freely move within axial bore 50 within limitations of aft driving cross pin 64 and forward driving pin 66.

Figure 9:
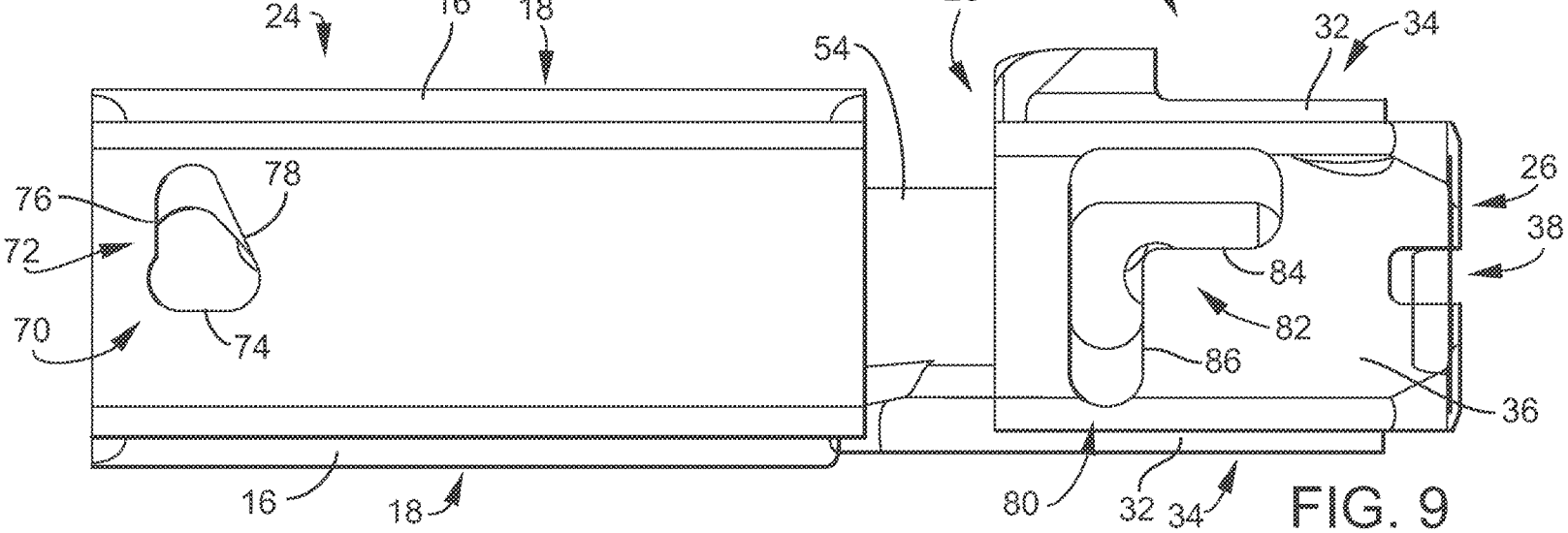
FIG. 9 is a bottom view of the rotating gun bolt assembly of FIG. 1.
Figure 10:
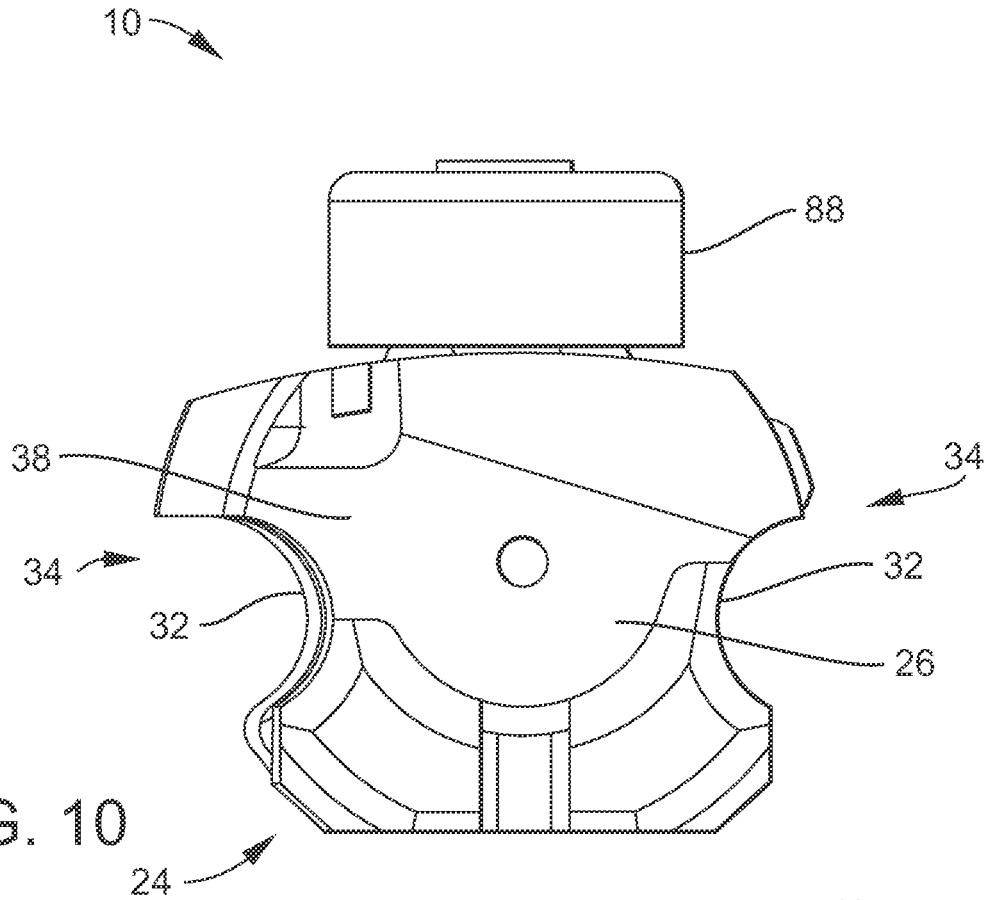
FIG. 10 is a front view of the rotating gun bolt assembly of FIG. 1.
Figure 11:
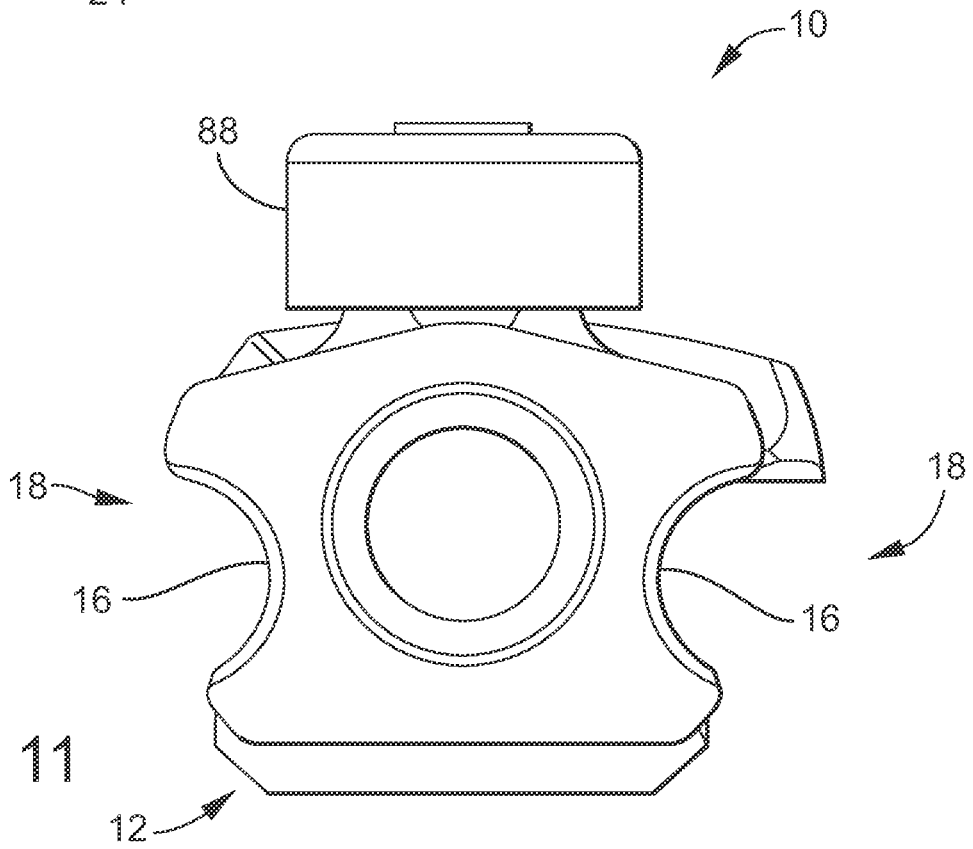
FIG. 11 is a rear view of the rotating gun bolt assembly of FIG. 1.
Figure 12:
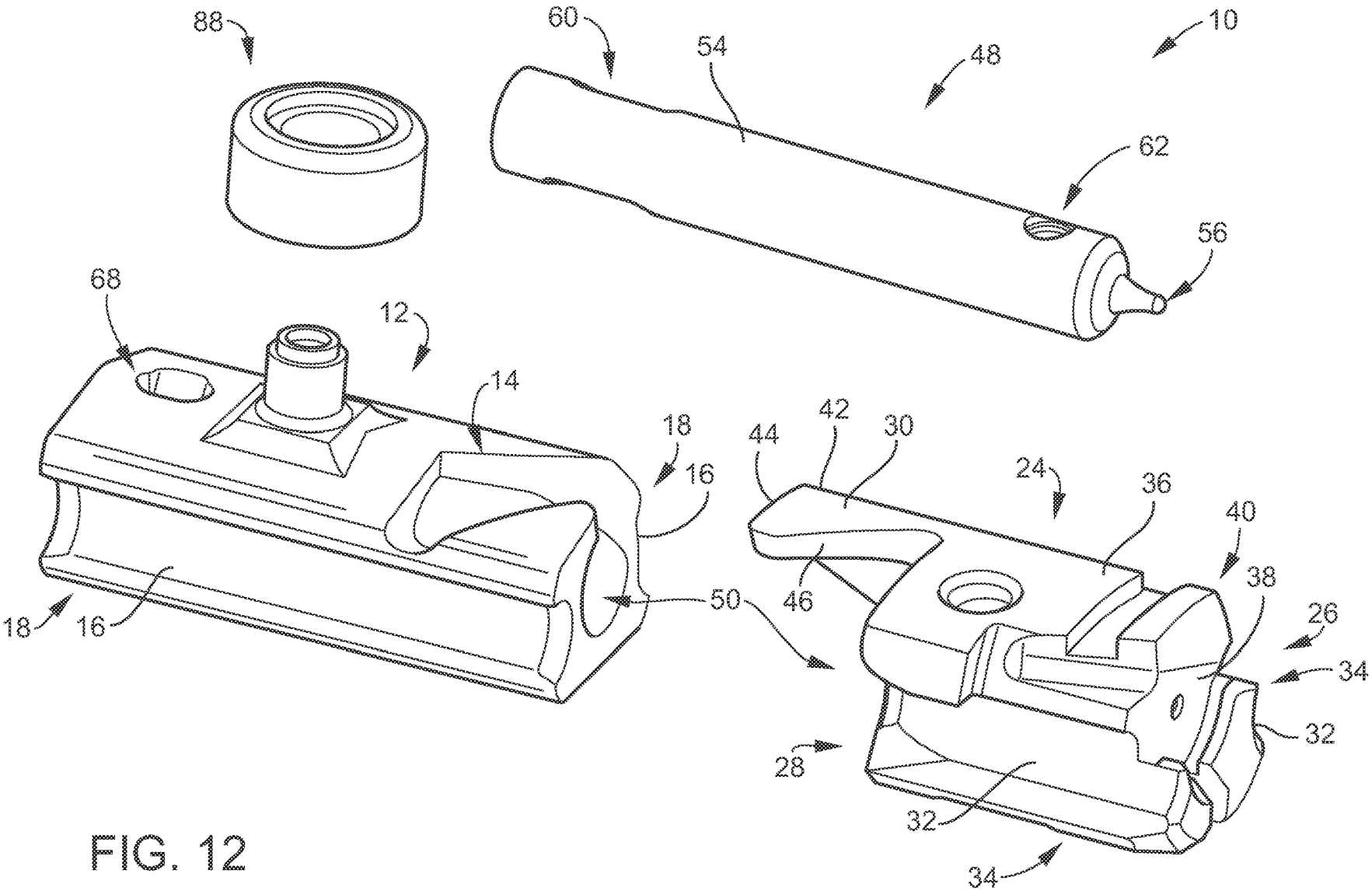
FIG. 12 is a partially disassembled top, front, left side perspective view of the rotating gun bolt assembly of FIG. 1.
Figure 13:
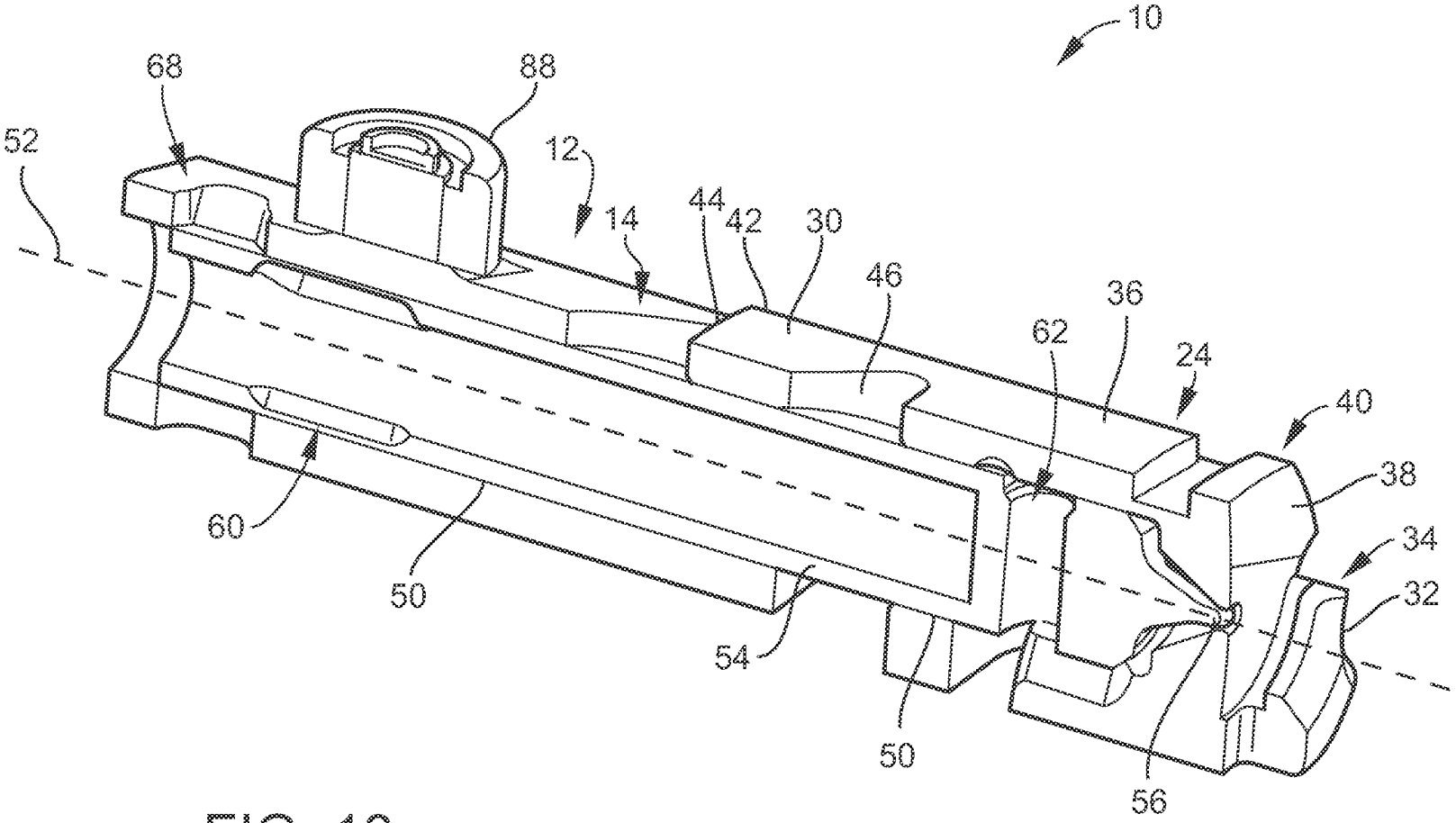
FIG. 13 is a cross-sectional top, front, left side perspective view of the rotating gun bolt assembly of FIG. 1, where the cross-sectional view is split down the middle from the left side to the right side.
Figure 14:
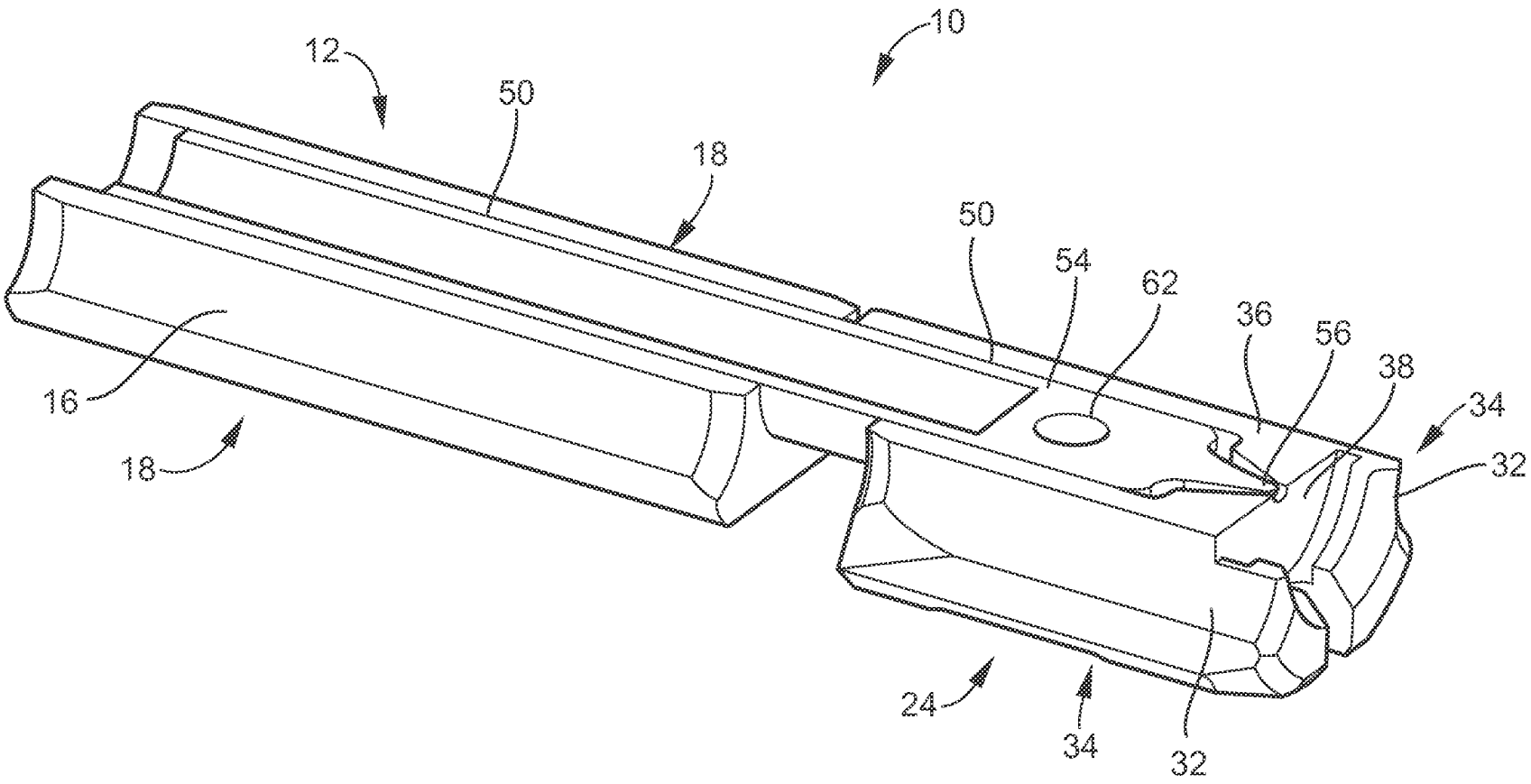
FIG. 14 is another cross-sectional top, front, left side perspective view of the rotating gun bolt assembly of FIG. 1, where the cross-sectional view is split down the middle from the top to the bottom.
Figure 15:
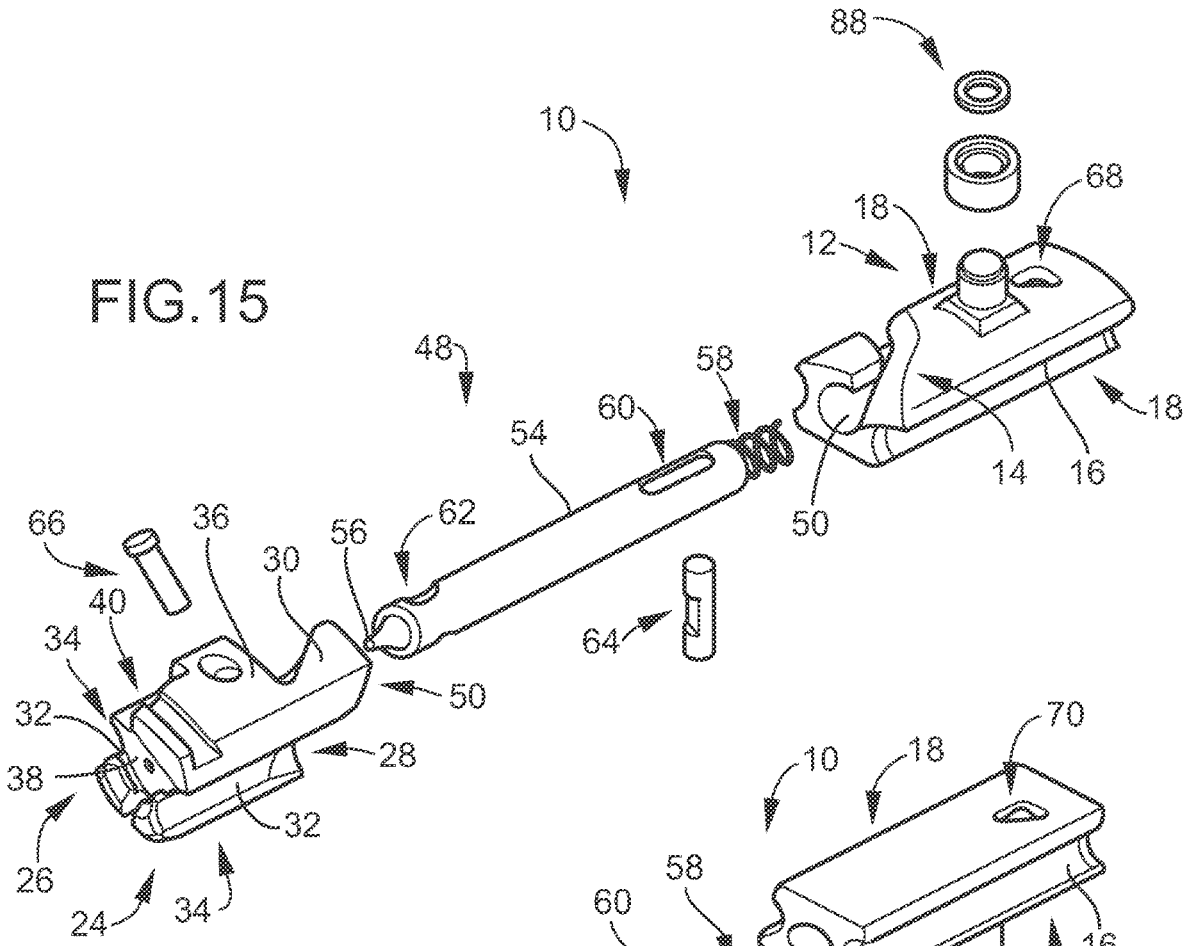
FIG. 15 is a partially disassembled top, front, right side perspective view of the rotating gun bolt assembly of FIG. 1.
Figure 16:
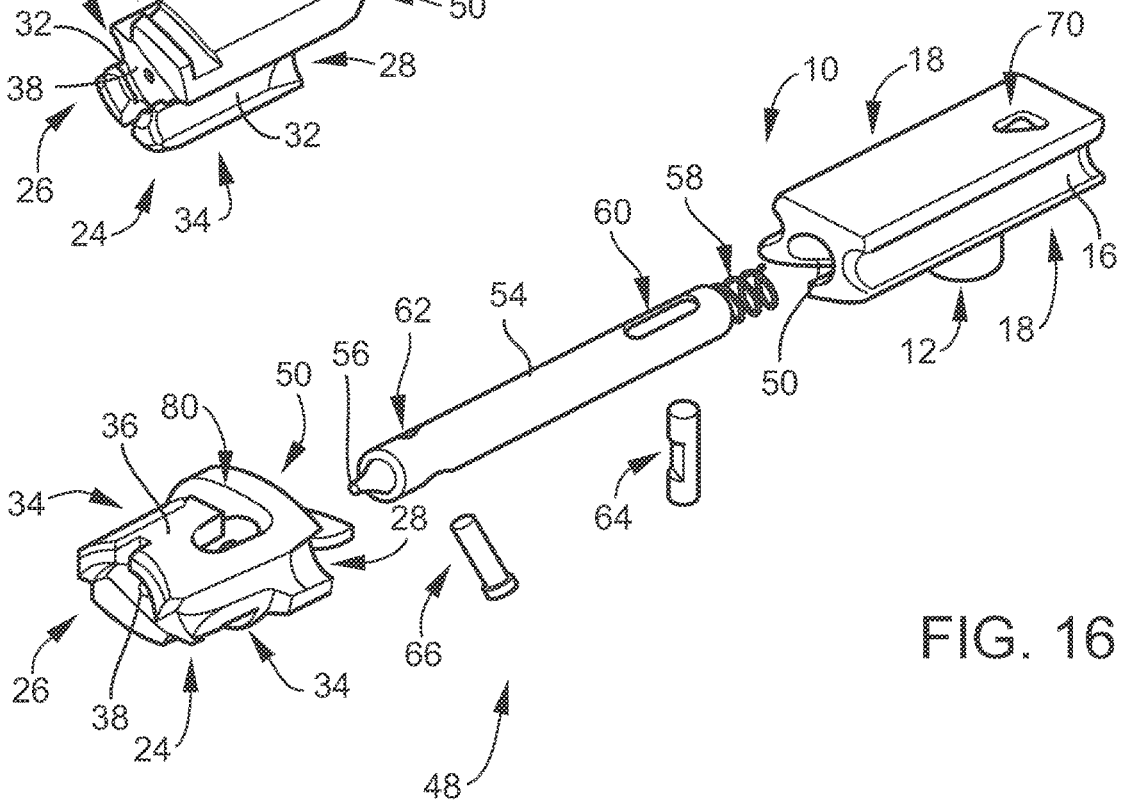
FIG. 16 is a partially disassembled bottom, front, left side perspective view of the rotating gun bolt assembly of FIG. 1.
Figure 17:
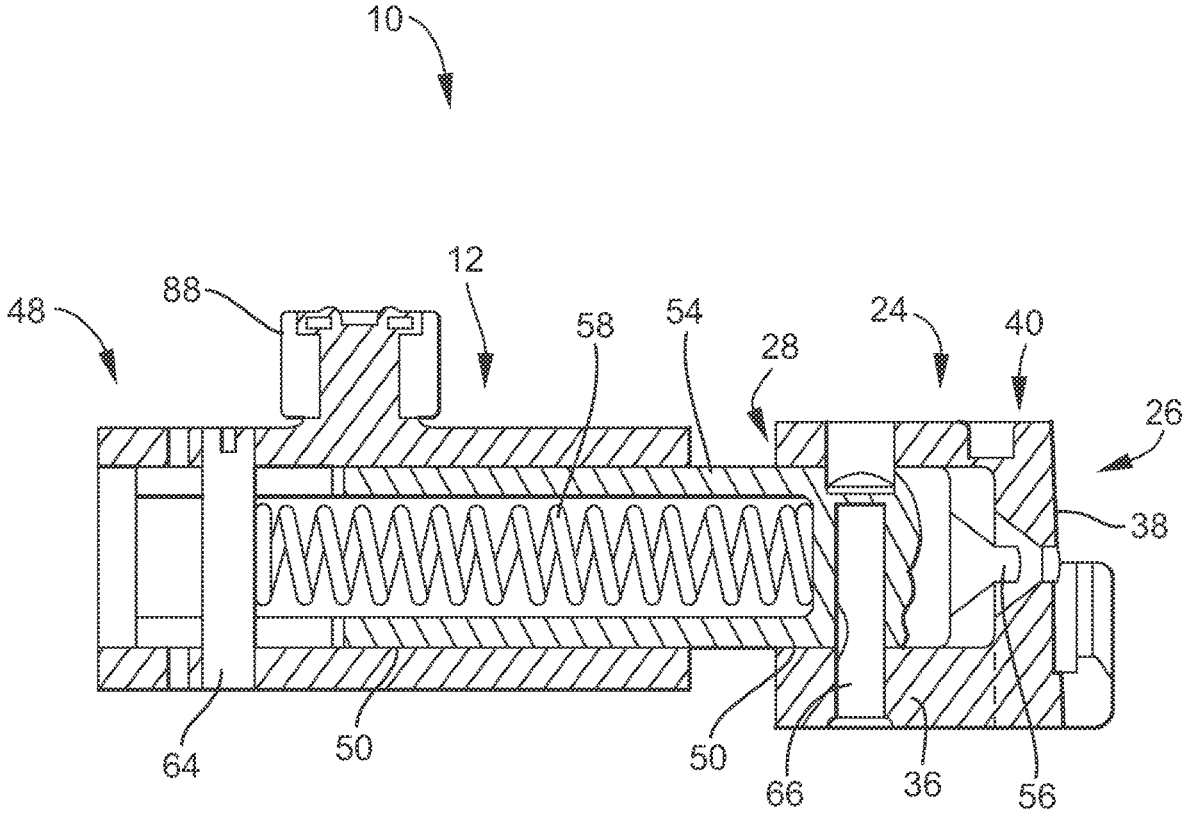
FIG. 17 is a cross-sectional side view of the rotating gun bolt assembly of FIG. 1.

As best shown in FIGS. 8, 9 and 18, another feature of rotating gun bolt assembly 10 may be the inclusion of top driving wedge 68 and bottom driving wedge 70 on main body subassembly 12. Top driving wedge 68 and bottom driving wedge 70 may be configured to control movement of aft driving cross pin 64 therein (see FIGS. 18A-18D). To facilitate the controlled movement of aft driving cross pin 64 therein, each of the top driving wedge 68 and the bottom driving wedge 79 may include triangular shape 72 with longitudinal surface 74, transverse surface 76, and hypotenuse surface 78.

As best shown in FIGS. 9 and 18, another feature of rotating gun bolt assembly 10 may be the inclusion of L-shaped slot 80 in head subassembly 24. L-shaped slot 80 may be configured to control the movement of forward driving pin 66 therein (see FIGS. 18A-18D). To facilitate the controlled movement of forward driving pin 66 therein, L-shaped slot 80 may include L-shape 82 with longitudinal leg 84, and transverse leg 86.

In select embodiments of rotating gun bolt assembly 10, main body subassembly 12 may further include cam bearing 88 positioned thereon. Cam bearing 88 may be configured to drive the axial movement of rotating gun bolt assembly 10 by means of an elliptical cam path (not shown) in a main housing (not shown) of firearm 94, as one skilled in the art clearly understands, like as commonly used for Gatling gun, miniguns, m134, GAU-2, or the like.

Figure 18A:
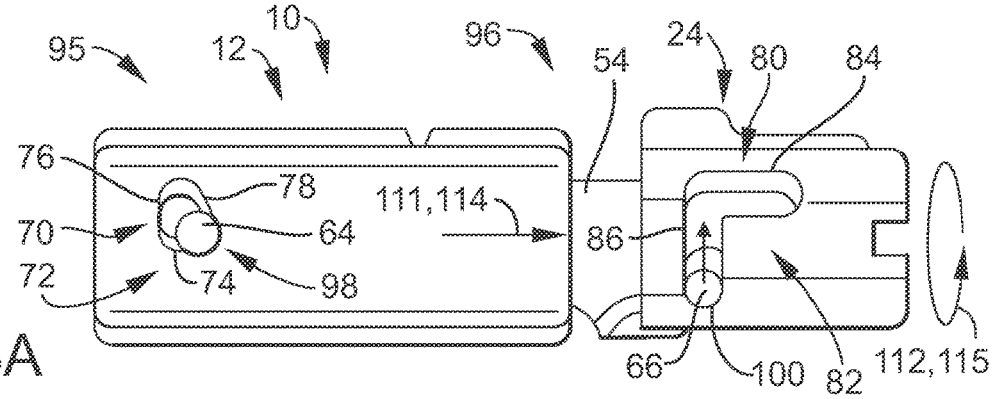
FIG. 18A is a bottom view of the rotating gun bolt assembly of FIG. 1 in a feed position.

Referring now specifically to FIG. 18A, another feature of rotating gun bolt assembly 10 may be that while in feed position 95, main body subassembly 12 and head subassembly 24 may be at maximum axial separation 96 where firing pin 54 aligns and supports axial and radial constraint of main body subassembly 12 and head subassembly 24 with aft driving cross pin 64 against longitudinal forward apex 98 created between longitudinal surface 74 and hypotenuse surface 78 of top driving wedge 68 and bottom driving wedge 70. In this feed position 95, forward driving pin 66 may be located in distal end 100 of transverse leg 86 of L-shaped slot 80. Firing pin spring 58 may be in a static compression attributed to aft driving cross pin 64 and rear axial slot 60 of firing pin 54.

Figure 18B:
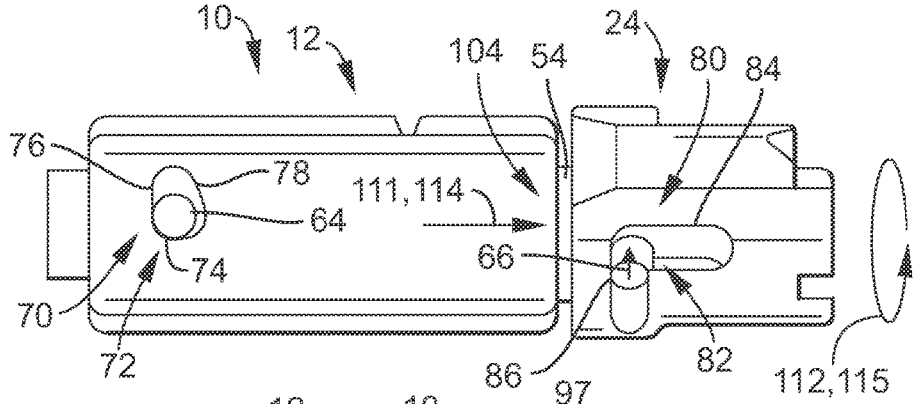
FIG. 18B is a bottom view of the rotating gun bolt assembly of FIG. 1 in a scared position.

Referring now specifically to FIG. 18B, another feature of rotating gun bolt assembly 10 may be that when firing pin spring 58 is compressed by main body subassembly 12 via cam bearing 88 following the elliptical cam path and creating rotational force 115 provided by helical tang 30 and helical receiving pocket 14, the tangential force 111 causes the forward driving pin 66 to move into scared position 104. In this scared position 104 shown in FIG. 18B, main body subassembly 12 and head subassembly 24 are at minimum axial separation 97, but have been compressed together with head subassembly 24 starting rotation around firing pin 54, where forward driving pin moves along transverse leg 86 toward longitudinal leg 84 of L-shaped slot 80.

Figure 18C:
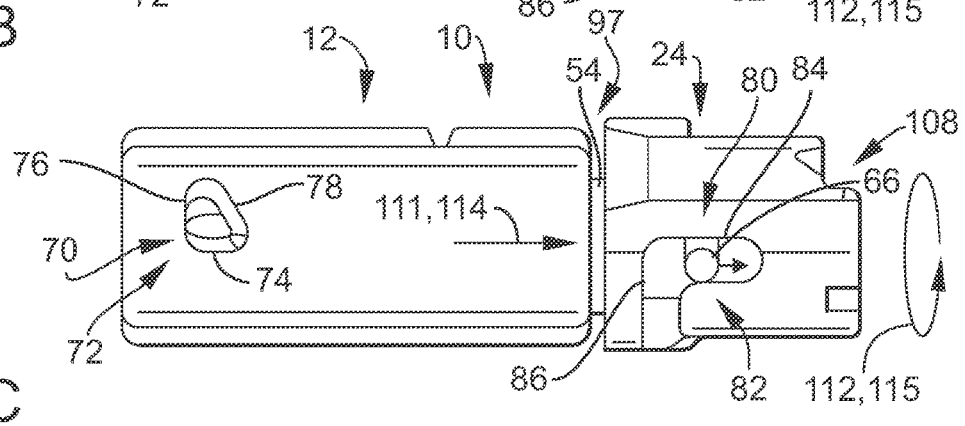
FIG. 18C is a bottom view of the rotating gun bolt assembly of FIG. 1 in an extraction function.

Referring now to FIG. 18C, another feature of rotating gun bolt assembly 10 may be that when firing pin spring 58 is continued to be compressed by main body subassembly 12 via cam bearing 88 following the elliptical path with the aft driving cross pin 64 located against longitudinal surfaces 74 of top driving wedge 68 and bottom driving wedge 70, the tangential force 111 causes the forward driving pin 66 in longitudinal leg 84 of L-shaped slot 80. Once forward driving pin 66 is in longitudinal leg 84, firing pin 54 is biased further into head subassembly 24 and forward primer striking end 56 of firing pin 54 extends forward of forward bolt face 38 through the hole therein thereby igniting a primer.

Figure 18D:
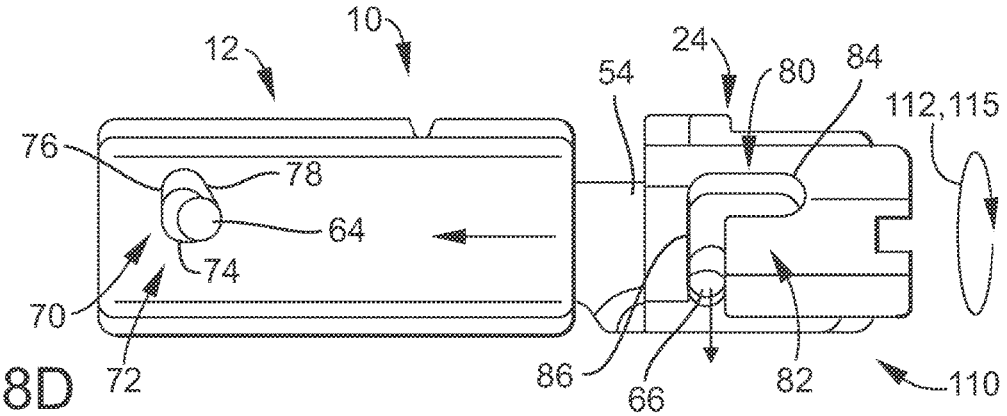
FIG. 18D is a bottom view of the rotating gun bolt assembly of FIG. 1 in a reset function.
Figure 19:
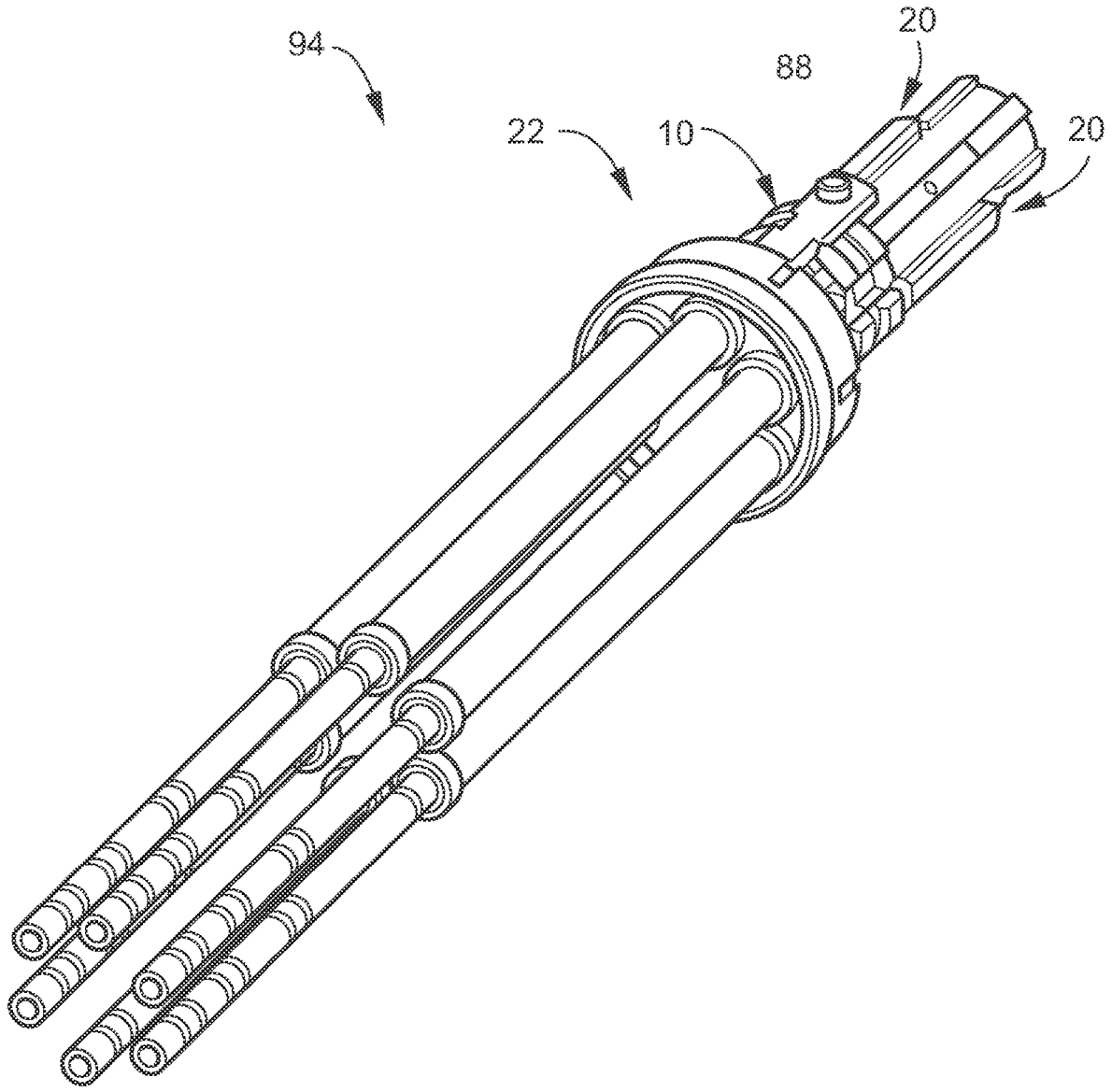
FIG. 19 is a perspective view of a rotator assembly of a firearm with the rotating gun bolt assembly of FIG. 1.
Figure 20:
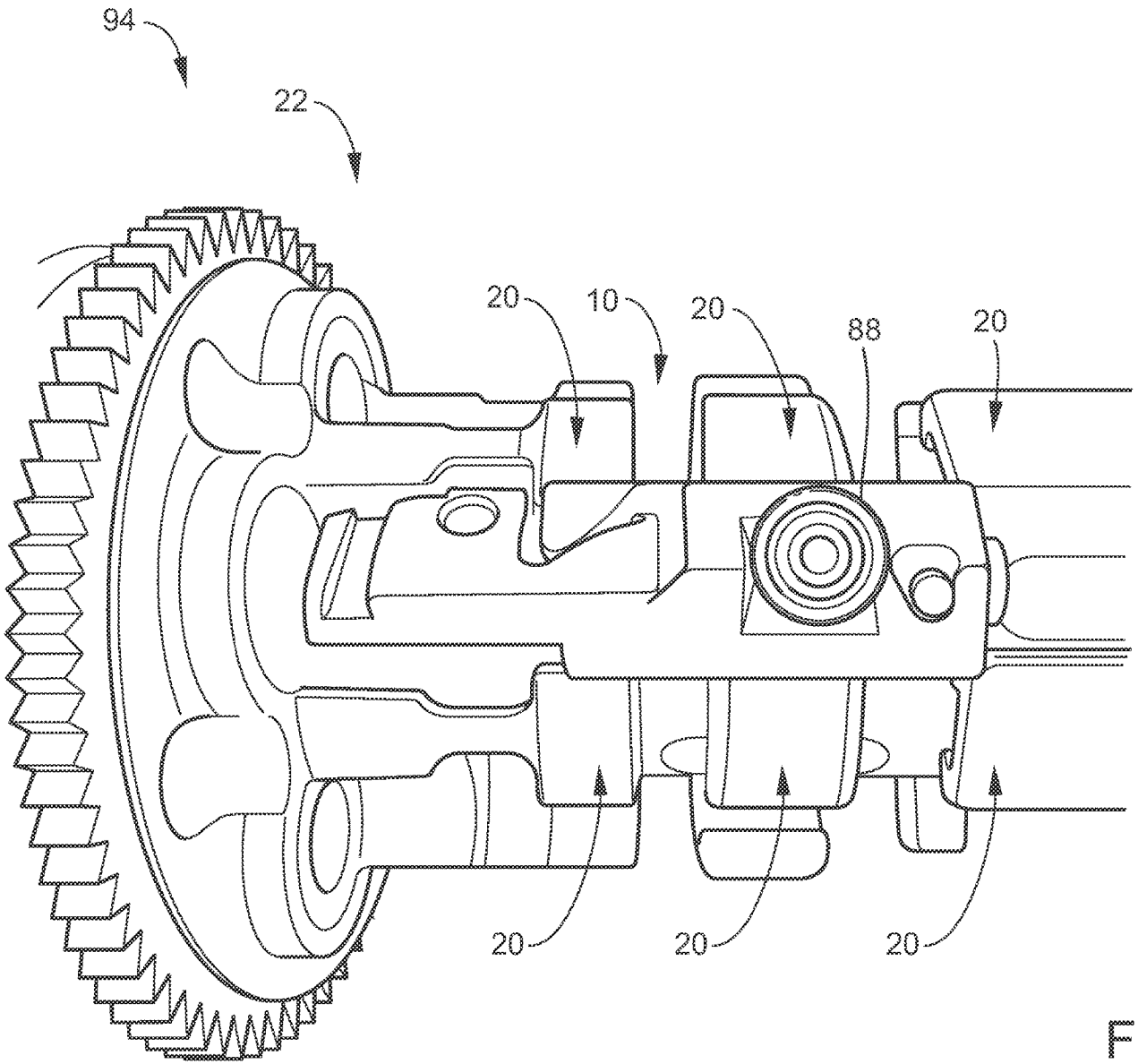
FIG. 20 is a zoomed in perspective view of the rotator assembly of FIG. 19 showing a zoomed in view of the rotating gun bolt assembly of FIG. 1.
Figure 21:
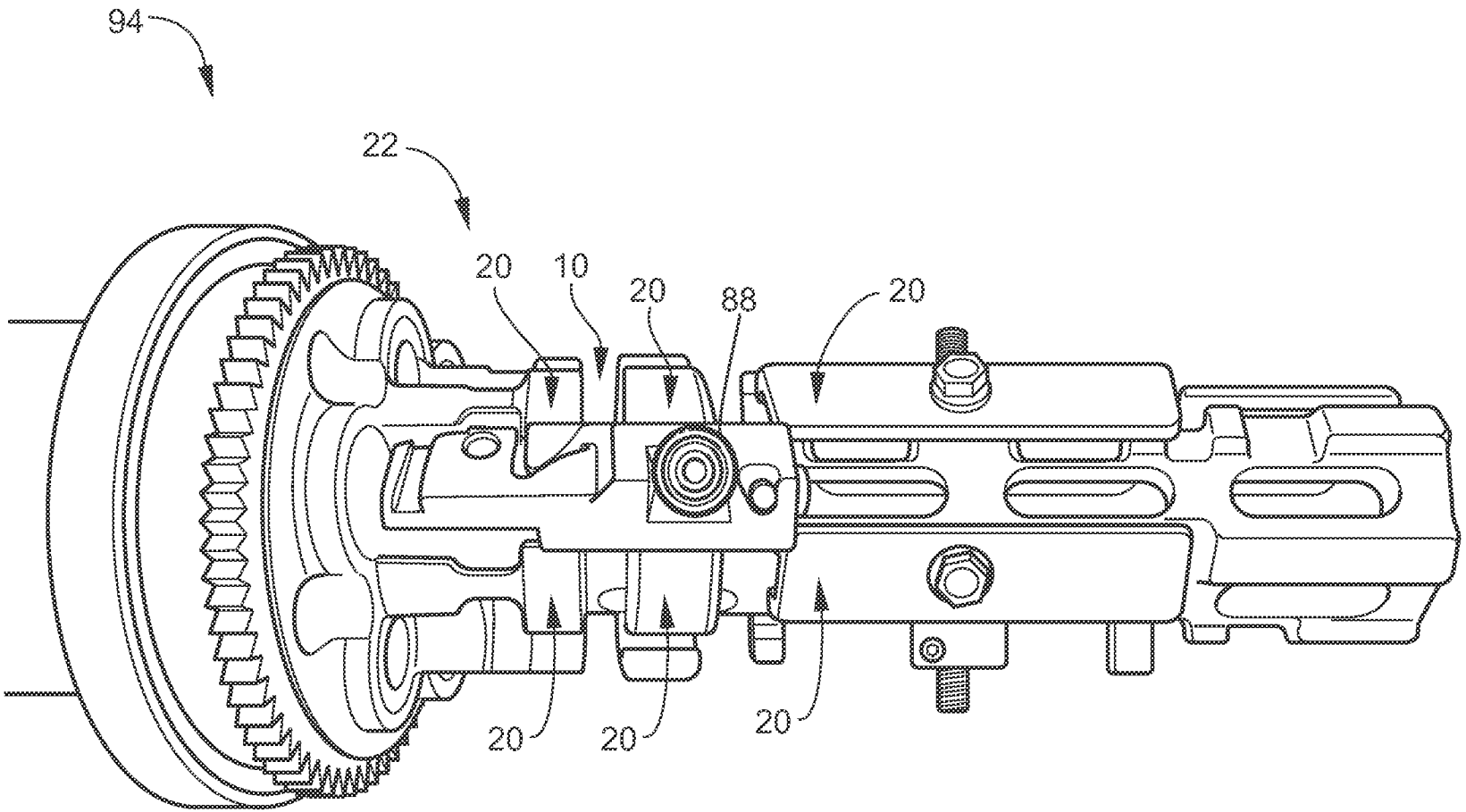
FIG. 21 is another zoomed in perspective view of the rotator assembly of FIG. 19 showing a zoomed in view of the rotating gun bolt assembly of FIG. 1 in an extraction function position.
Figure 22:
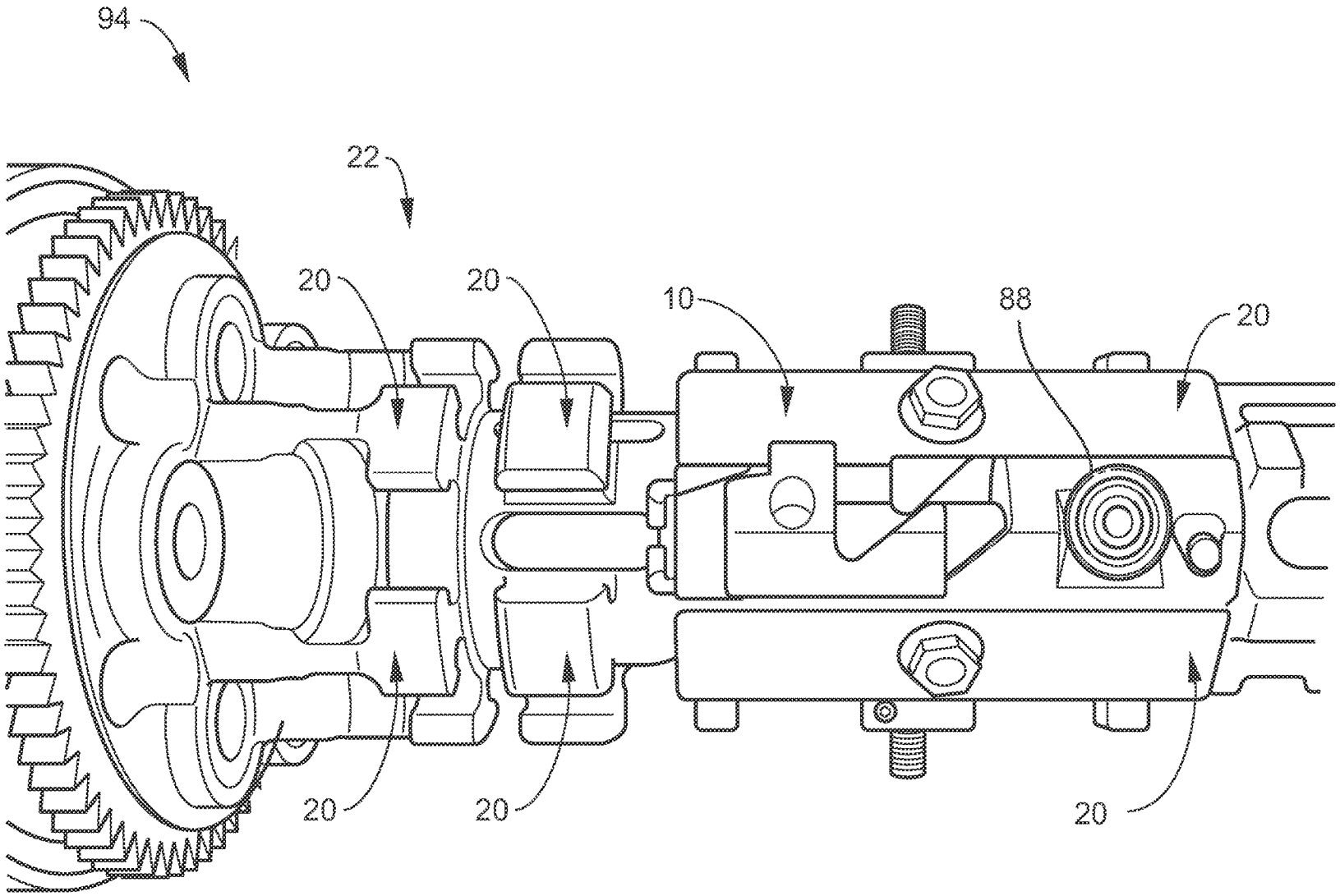
FIG. 22 is another zoomed in perspective view of the rotator assembly of FIG. 19 showing a zoomed in view of the rotating gun bolt assembly of FIG. 1 in a feed position.
Figure 23:
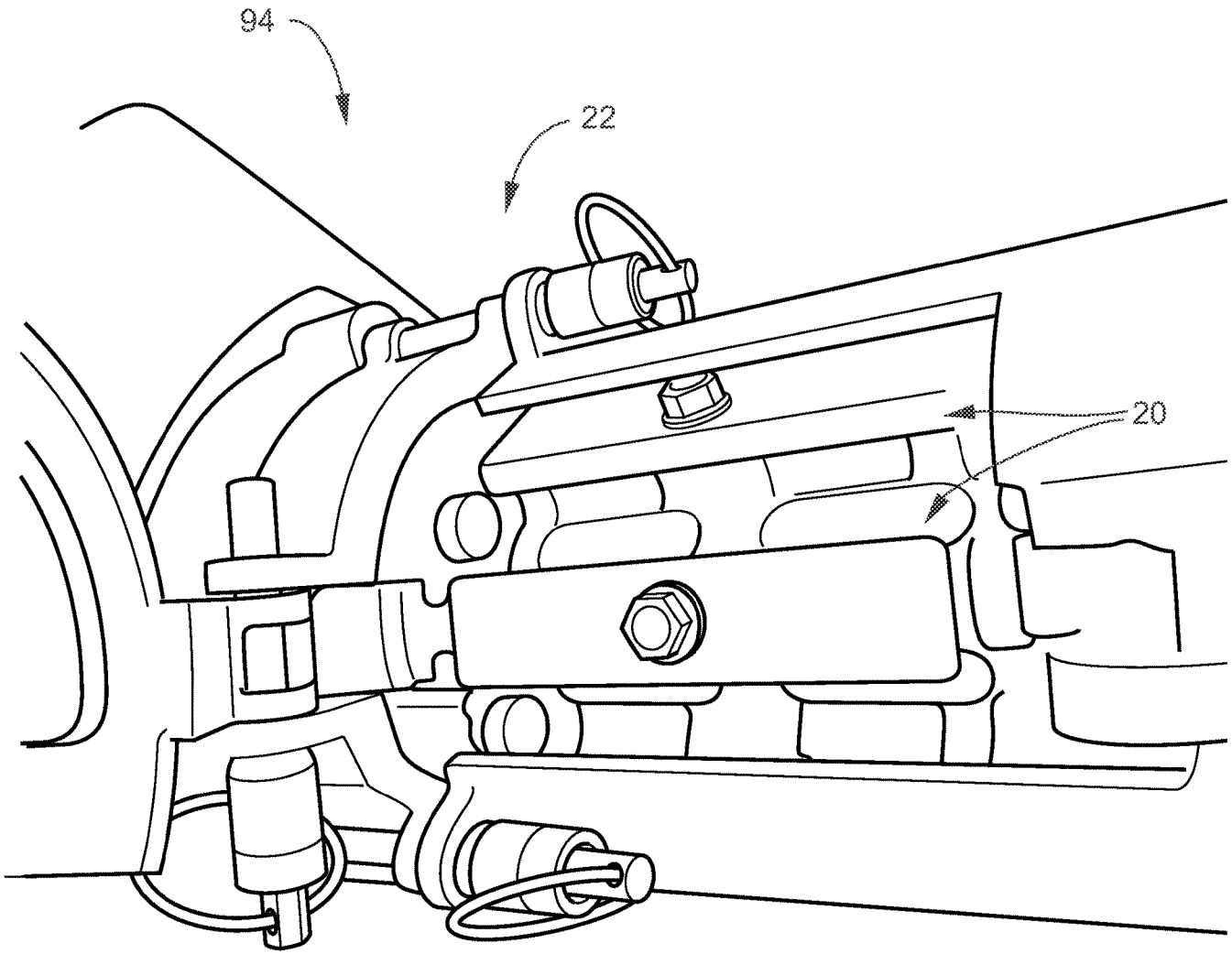
FIG. 23 is another zoomed in perspective view of the rotator assembly of FIG. 19 with the rotating gun bolt assembly removed showing the guides.

Referring now specifically to FIG. 18D, another feature of rotating gun bolt assembly 10 may be that during extraction function 108, forward driving pin 66 may be forced to traverse leg 86 of L-shaped slot 80 to positively withdraw forward primer striking end 56 back into head subassembly 24. Still referring specifically to FIG. 18D, another feature of rotating gun bolt assembly 10 may be that during reset function 110, aft driving cross pin 64 may be forced relatively forward along hypotenuse surface 78 of top driving wedge 68 and bottom driving wedge 70 to swing forward driving pin 66 back into distal end 100 of transverse leg 86 of L-shaped slot 80.

In another aspect, the instant disclosure embraces rotating gun bolt assembly 10 in any embodiment and/or combination of embodiments shown and/or described herein, like as shown in FIGS. 1-18.

In another aspect, the instant disclosure embraces firearm 94 with rotating gun bolt assembly 10 in any embodiment and/or combination of embodiments shown and/or described herein, like as shown in FIGS. 1-23. Firearm 94 with the disclosed rotating gun bolt assembly 10, as used and shown herein, may include, but is not limited to, a Gatling gun, a minigun, an m134, a GAU-2, or the like. Rotor assembly 22 with guides 20 used in such firearm 94 is shown in FIGS. 19-23.

In sum, in view of the foregoing disadvantages inherent in the known types of bolts, like the Dillon Bolt and the GE Bolt, the instant disclosure provides a firearm bolt, or rotating gun bolt assembly 10. Rotating gun bolt assembly 10 may provide stronger and fatigue resistant interface of the bolt head and body, like via helical mating surfaces 117 created between helical tang 30 and helical receiving pocket 14. The present disclosure's general purpose may be to provide a new and improved firearm bolt that is backwards compatible with existing M-134 systems and yet even more sturdy and reliable than the prior art bolt systems.

The present disclosure may be an improvement on both the GE Bolt and the Dillon Bolt structures in that the twisting motion of the bolt head is accomplished by translating the compression force into rotational force imparting the rotational force into head subassembly 24 and main body subassembly 12 along longitudinal axis 52 parallel to guides 20, thereby imparting a twisting motion to head subassembly 24 as it translates along main body subassembly 24 while imparting the forces back into the main structure of the rotor assembly 22 that holds and guides rotating gun bolt assembly 10 throughout the longitudinal travel along the axis.

To accomplish these objectives, rotating gun bolt assembly 10 comprises head subassembly 24 with a large helical tang 30 and main body subassembly 12 has a corresponding helical receiving pocket 14 while the firing pin 54 is free to move, with in the limitations of the driving pins 64 and 66, through both the head subassembly 24 and main body subassembly 12. The disclosed design of rotating gun bolt assembly 10 may reduce the concentrated rotational and compression loads 114 on the head structure greatly by increasing the width and height of the torque arm (helical tang 30) of interfacing structures, but also further dividing the torque along the entire surface of the helical arm (helical tang 30) and pocket (helical receiving pocket 14), torque differentials are imparted to the body in a tangential load versus the previous perpendicular designs, along the twist imparting mechanism. Also, since the twist mechanism is in the exterior of the firearm bolt, it is easily manufactured to be compatible with current M-134 designs, but also easily incorporated into future designs.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A rotating gun bolt assembly comprising:

a main body subassembly including a helical receiving pocket;

a head subassembly including a head end and a rear end, the rear end of the head subassembly including a helical tang extending from the rear end and mated inside the helical receiving pocket in the main body subassembly;

the helical tang including:

a straight side extending perpendicular from the rear end of the head subassembly;

a distal edge extending perpendicular to the straight side, where the distal edge is parallel with the rear end of the head subassembly; and a helical side extending helically from the rear end of the head subassembly to the distal edge of the helical tang;

wherein, when the head subassembly and the main body subassembly are compressed, the helical receiving pocket exerts tangential forces on the distal edge of the helical tang configured to rotate the head subassembly about a longitudinal axis of the rotating gun bolt assembly.

2. The rotating gun bolt assembly of claim 1, wherein:

the main body subassembly including lateral main body slots on opposite main body sides of the main body subassembly, the lateral main body slots are configured to move the main body subassembly longitudinally along guides of a rotor assembly;

the head subassembly including lateral head slots on opposite head sides of the head subassembly, the lateral head slots are configured to move the head subassembly longitudinally along the guides; and wherein, twisting of the head subassembly about the longitudinal axis is accomplished by translating compression forces between the head subassembly and the main body subassembly into a rotational force imparted into the main body subassembly and head subassembly along the longitudinal axis parallel to the guides.

3. The rotating gun bolt assembly of claim 2, whereby a twisting motion is imparted to the head subassembly as the head subassembly translates longitudinally along the main body subassembly while imparting the rotational force back into the guides throughout longitudinal travel along the longitudinal axis.

4. The rotating gun bolt assembly of claim 1, wherein the helical tang on the head subassembly and lateral main body slots on the main body subassembly are configured as such that compression loads and rotational loads implied are imparted to the head subassembly and the main body subassembly as tangential loads are divided across the head subassembly and the main body subassembly through helical mating surfaces created by the helical receiving pocket and the helical tang, while supported by a mass of material with a base having a width, and a length of the helical tang.

5. The rotating gun bolt assembly of claim 1 further comprising a firing pin subassembly positioned within an axial bore along a longitudinal axis of the rotating gun bolt assembly through the main body subassembly and the head subassembly; and the firing pin subassembly is configured to support axial and radial constraint between the main body subassembly and the head subassembly.

6. The rotating gun bolt assembly of claim 5, wherein the firing pin subassembly including:

a firing pin having a forward primer striking end initially contained in the head subassembly, the firing pin is biased from the main body subassembly toward the head subassembly via a firing pin spring, the firing pin including a rear axial slot and a forward hole;

an aft driving cross pin positioned through the rear axial slot of the firing pin, the firing pin spring biases the firing pin via the aft driving cross pin;

a forward driving pin positioned through the forward hole of the firing pin; and wherein, the firing pin is configured to freely move within the axial bore within limitations of the aft driving cross pin and the forward driving pin.

7. The rotating gun bolt assembly of claim 6, wherein:

the main body subassembly including a top driving wedge and a bottom driving wedge configured to control movement of the aft driving cross pin therein, each of the top driving wedge and the bottom driving wedge including a triangular shape with a longitudinal surface, a transverse surface, and a hypotenuse surface; and the head subassembly including an L-shaped slot configured to control the movement of the forward driving pin therein, the L-shaped slot including an L-shape with a longitudinal leg, and a transverse leg.

8. The rotating gun bolt assembly of claim 7, wherein the main body subassembly further including a cam bearing positioned thereon, the cam bearing is configured to drive the axial movement of the rotating gun bolt assembly.

9. The rotating gun bolt assembly of claim 8, wherein:

while in a feed position, the main body subassembly and the head subassembly are at a maximum axial separation where the firing pin aligns and supports axial and radial constraint of the main body subassembly and the head subassembly with the aft driving cross pin against a longitudinal forward apex between the longitudinal surface and the hypotenuse surface of the top driving wedge and the bottom driving wedge, and the forward driving pin is located in a distal end of the transverse leg of said L-shaped slot, the firing pin spring is in a static compression attributed to the aft driving cross pin and the rear axial slot of the firing pin;

when the firing pin spring is compressed by the main body subassembly a rotational force is provided by the helical tang and the helical receiving pocket, a tangential force causes the forward driving pin to move into a scared position, where the main body subassembly and the head subassembly are at a minimum axial separation with the head subassembly having been rotated around the firing pin; and when the firing pin spring is continued to be compressed by the main body subassembly with the aft driving cross pin located against the longitudinal surface of the top driving wedge and the bottom driving wedge, the tangential force causes the forward driving pin into the longitudinal leg of the L-shaped slot, where the firing pin is biased further into the head subassembly and the forward primer striking end of the firing pin extending forward of a forward bolt face thereby igniting a primer.

10. The rotating gun bolt assembly of claim 9, wherein during an extraction function, the forward driving pin is forced to the traverse leg of the L-shaped slot to positively withdraw the forward primer striking end into the head subassembly, and during a reset function the aft driving cross pin is forced relatively forward along the hypotenuse surface of the top driving wedge and the bottom driving wedge to swing the forward driving pin into the distal end of the transverse leg of said L-shaped slot.

11. The rotating gun bolt assembly of claim 1, wherein the head subassembly further includes a head body having a forward bolt face and extractor lugs.

12. A rotating gun bolt assembly comprising:

a main body subassembly including a helical receiving pocket, the main body subassembly including lateral main body slots on opposite main body sides of the main body subassembly, the lateral main body slots are configured to move the main body subassembly longitudinally along guides of a rotor assembly;

a head subassembly including a head end and a rear end, the rear end of the head subassembly including a helical tang extending from the rear end and mated inside the helical receiving pocket in the main body subassembly, the head subassembly including lateral head slots on opposite head sides of the head subassembly, the lateral head slots are configured to move the head subassembly longitudinally along the guide, the head subassembly further including a head body having a forward bolt face and extractor lugs;

the helical tang including:

a straight side extending perpendicular from the rear end of the head subassembly;

a distal edge extending perpendicular to the straight side, where the distal edge is parallel with the rear end of the head subassembly;

a helical side extending helically from the rear end of the head subassembly to the distal edge of the helical tang;

a firing pin subassembly positioned within an axial bore along a longitudinal axis of the rotating gun bolt assembly through the main body subassembly and the head subassembly, the firing pin subassembly is configured to support axial and radial constraint between the main body subassembly and the head subassembly, the firing pin subassembly including:

a firing pin having a forward primer striking end initially contained in the head subassembly, the firing pin is biased from the main body subassembly toward the head subassembly via a firing pin spring, the firing pin including a rear axial slot and a forward hole;

an aft driving cross pin positioned through the rear axial slot of the firing pin, the firing pin spring biases the firing pin via the aft driving cross pin;

a forward driving pin positioned through the forward hole of the firing pin;

wherein, the firing pin is configured to freely move within the axial bore within limitations of the aft driving cross pin and the forward driving pin;

the main body subassembly including a top driving wedge and a bottom driving wedge configured to control movement of the aft driving cross pin therein, each of the top driving wedge and the bottom driving wedge including a triangular shape with a longitudinal surface, a transverse surface, and a hypotenuse surface;

the head subassembly including an L-shaped slot configured to control the movement of the forward driving pin therein, the L-shaped slot including an L-shape with a longitudinal leg, and a transverse leg;

the main body subassembly further including a cam bearing positioned thereon, the cam bearing is configured to drive axial movement of the rotating gun bolt assembly;

wherein, when the head subassembly and the main body subassembly are compressed, the helical receiving pocket exerts tangential forces on the distal edge of the helical tang configured to rotate the head subassembly about the longitudinal axis of the rotating gun bolt assembly;

wherein, twisting of the head subassembly about the longitudinal axis is accomplished by translating compression forces between the head subassembly and the main body subassembly into a rotational force imparted into the main body subassembly and head subassembly along the longitudinal axis parallel to the guides;

whereby a twisting motion is imparted to the head subassembly as the head subassembly translates longitudinally along the main body subassembly while imparting the rotational force back into the guides throughout longitudinal travel along the longitudinal axis;

wherein the helical tang on the head subassembly and lateral main body slots on the main body subassembly are configured as such that compression loads and rotational loads implied are imparted to the head subassembly and the main body subassembly as tangential loads are divided across the head subassembly and the main body subassembly through helical mating surfaces created by the helical receiving pocket and the helical tang, while supported by a mass of material with a base having a width and a length of the helical tang;

wherein:

while in a feed position, the main body subassembly and the head subassembly are at a maximum axial separation where the firing pin aligns and supports axial and radial constraint of the main body subassembly and the head subassembly with the aft driving cross pin against the longitudinal forward apex between the longitudinal surface and the hypotenuse surface of the top driving wedge and the bottom driving wedge, and the forward driving pin is located in a distal end of the transverse leg of said L-shaped slot, the firing pin spring is in a static compression attributed to the aft driving cross pin and the rear axial slot of the firing pin;

when the firing pin spring is compressed by the main body subassembly until the rotational force created by the helical tang and the helical receiving pocket cause the forward driving pin to move into a scared position, where the main body subassembly and the head subassembly are at a minimum axial separation with the head subassembly having been rotated around the firing pin;

when the firing pin spring is continued to be compressed by the main body subassembly with the aft driving cross pin located against the longitudinal surfaces of the top driving wedge and the bottom driving wedge, the tangential forces causes the forward driving pin into the longitudinal leg of the L-shaped slot, where the firing pin is biased further into the head subassembly and the forward primer striking end of the firing pin extending forward of the forward bolt face thereby igniting a primer;

during an extraction function, the forward driving pin is forced to the traverse leg of the L-shaped slot to positively withdraw the forward primer striking end into the head subassembly; and during a reset function, the aft driving cross pin is forced relatively forward along the hypotenuse surface of the top driving wedge and the bottom driving wedge to swing the forward driving pin into the distal end of the transverse leg of said L-shaped slot.

13. A firearm comprising:

a rotating gun bolt assembly comprising:

a main body subassembly including a helical receiving pocket;

a head subassembly including a head end and a rear end, the rear end of the head subassembly including a helical tang extending from the rear end and mated inside the helical receiving pocket in the main body subassembly;

the helical tang including:

a straight side extending perpendicular from the rear end of the head subassembly;

a distal edge extending perpendicular to the straight side, where the distal edge is parallel with the rear end of the head subassembly; and a helical side extending helically from the rear end of the head subassembly to the distal edge of the helical tang;

wherein, when the head subassembly and the main body subassembly are compressed, the helical receiving pocket exerts tangential forces on the distal edge of the helical tang configured to rotate the head subassembly about a longitudinal axis of the rotating gun bolt assembly.

14. The firearm of claim 13, wherein:

the main body subassembly including lateral main body slots on opposite main body sides of the main body subassembly, the lateral main body slots are configured to move the main body subassembly longitudinally along guides of a rotor assembly;

the head subassembly including lateral head slots on opposite head sides of the head subassembly, the lateral head slots are configured to move the head subassembly longitudinally along the guides;

wherein, twisting of the head subassembly about the longitudinal axis is accomplished by translating compression forces between the head subassembly and the main body subassembly into a rotational force imparted into the main body subassembly and head subassembly along the longitudinal axis parallel to the guides;

whereby a twisting motion is imparted to the head subassembly as it the head subassembly translates longitudinally along the main body subassembly while imparting the rotational forces back into the guides throughout longitudinal travel along the longitudinal axis; and wherein the helical tang on the head subassembly and lateral main body slots on the main body subassembly are configured as such that compression loads and rotational loads implied are imparted to the head subassembly and the main body subassembly as tangential loads are divided across the head subassembly and the main body subassembly through helical mating surfaces created by the helical receiving pocket and the helical tang, while supported by a mass of material with a base having a width, and a length of the helical tang.

15. The firearm of claim 14 further comprising a firing pin subassembly positioned within an axial bore along the longitudinal axis of the rotating gun bolt assembly through the main body subassembly and the head subassembly; and the firing pin subassembly is configured to support axial and radial constraint between the main body subassembly and the head subassembly.

16. The firearm of claim 15, wherein the firing pin subassembly including:

a firing pin having a forward primer striking end initially contained in the head subassembly, the firing pin is biased from the main body subassembly toward the head subassembly via a firing pin spring, the firing pin including a rear axial slot and a forward hole;

an aft driving cross pin positioned through the rear axial slot of the firing pin, the firing pin spring biases the firing pin via the aft driving cross pin;

a forward driving pin positioned through the forward hole of the firing pin; and wherein, the firing pin is configured to freely move within the axial bore within limitations of the aft driving cross pin and the forward driving pin.

17. The firearm of claim 16, wherein:

the main body subassembly including a top driving wedge and a bottom driving wedge configured to control movement of the aft driving cross pin therein, each of the top driving wedge and the bottom driving wedge including a triangular shape with a longitudinal surface, a transverse surface, and a hypotenuse surface; and the head subassembly including an L-shaped slot configured to control the movement of the forward driving pin therein, the L-shaped slot including an L-shape with a longitudinal leg, and a transverse leg.

18. The firearm of claim 17, wherein the main body subassembly further including a cam bearing positioned thereon, the cam bearing is configured to drive the axial movement of the rotating gun bolt assembly;

wherein:

while in a feed position, the main body subassembly and the head subassembly are at a maximum axial separation where the firing pin aligns and supports axial and radial constraint of the main body subassembly and the head subassembly with the aft driving cross pin against a longitudinal forward apex between the longitudinal surface and the hypotenuse surface of the top driving wedge and the bottom driving wedge, and the forward driving pin is located in a distal end of the transverse leg of said L-shaped slot, the firing pin spring is in a static compression attributed to the aft driving cross pin and the rear axial slot of the firing pin;

when the firing pin spring is compressed by the main body subassembly until the rotational force created by the helical tang and the helical receiving pocket, the tangential force causes the forward driving pin to move into a scared position, where the main body subassembly and the head subassembly are at a minimum axial separation with the head subassembly having been rotated around the firing pin; and when the firing pin spring is continued to be compressed by the main body subassembly with the aft driving cross pin located against longitudinal surfaces of the top driving wedge and the bottom driving wedge, the tangential force causes the forward driving pin into the longitudinal leg of the L-shaped slot, where the firing pin is biased further into the head subassembly and the forward primer striking end of the firing pin extending forward of forward bolt face thereby igniting a primer.

19. The firearm of claim 18, wherein during an extraction function, the forward driving pin is forced to the traverse leg of the L-shaped slot to positively withdraw the forward primer striking end into the head subassembly, and during a reset function the aft driving cross pin is forced relatively forward along the hypotenuse surface of the top driving wedge and the bottom driving wedge to swing the forward driving pin into the distal end of the transverse leg of said L-shaped slot.

* * * * *